US010282977B2

(12) United States Patent
Witkowski

(10) Patent No.: US 10,282,977 B2
(45) Date of Patent: May 7, 2019

(54) TRAINING AND CONTROLLING MULTIPLE FUNCTIONS OF A REMOTE DEVICE WITH A SINGLE CHANNEL OF A TRAINABLE TRANSCEIVER

(71) Applicant: Gentex Corporation, Zeeland, MI (US)

(72) Inventor: Todd R. Witkowski, Zeeland, MI (US)

(73) Assignee: GENTEX CORPORATION, Zeeland, MI (US)

( * ) Notice: Subject to any disclaimer, the term of this patent is extended or adjusted under 35 U.S.C. 154(b) by 0 days.

(21) Appl. No.: 15/893,298

(22) Filed: Feb. 9, 2018

(65) Prior Publication Data

US 2018/0233029 A1 Aug. 16, 2018

Related U.S. Application Data

(60) Provisional application No. 62/457,509, filed on Feb. 10, 2017.

(51) Int. Cl.
*G08C 17/02* (2006.01)

(52) U.S. Cl.
CPC ..... *G08C 17/02* (2013.01); *G08C 2201/20* (2013.01); *G08C 2201/92* (2013.01)

(58) Field of Classification Search
CPC ..... B65H 2220/01; B65H 2220/03; G08C 2201/62; H04L 12/282; G07C 2009/00507; G07C 2009/00865; G07C 2009/00928; G07C 9/00857; H04W 4/70; H04W 76/14
See application file for complete search history.

(56) References Cited

U.S. PATENT DOCUMENTS 5,442,340 A 8/1995 Dykema
5,699,054 A * 12/1997 Duckworth ..... G08C 17/02 340/13.24
6,703,941 B1 * 3/2004 Blaker ..... G08C 17/02 340/12.28

(Continued)

OTHER PUBLICATIONS

International Search Report dated Aug. 16, 2018, received in corresponding to US Application No. 2018/017669, 2 pages.

(Continued)

*Primary Examiner* — Mirza F Alam
(74) *Attorney, Agent, or Firm* — Foley & Lardner LLP; Bradley D. Johnson

(57) ABSTRACT

The present disclosure is directed to systems and methods of training and controlling multiple functions of a remote device with a single transceiver channel. A trainable transceiver may detect a button press on a command button corresponding to a channel. The trainable transceiver may identify the channel as trained to control a first function of the remote device. The trainable transceiver may determine that a second function of the remote device satisfies a message similarity condition with the first function. The trainable transceiver may train the channel to control both the first function and the second function, responsive to determining that the second function satisfies the message similarity condition with the first function. The trainable transceiver may configure the command button to transmit control signals to alternately actuate the first function and the second function of the remote device responsive to successive button presses.

19 Claims, 7 Drawing Sheets

(56) References Cited

U.S. PATENT DOCUMENTS

| | | | | |
|---|---|---|---|---|
| 2005/0024185 | A1* | 2/2005 | Chuey | G08C 17/02 340/5.71 |
| 2010/0301999 | A1 | 12/2010 | Carlson | |
| 2011/0018694 | A1* | 1/2011 | Geerlings | G08C 17/02 340/12.28 |
| 2014/0112332 | A1* | 4/2014 | Park | H04W 56/002 370/350 |
| 2015/0302734 | A1* | 10/2015 | Geerlings | G08C 19/28 340/5.25 |
| 2015/0364033 | A1 | 12/2015 | Witkowski et al. | |
| 2017/0079082 | A1* | 3/2017 | Papay | H04W 48/10 |

OTHER PUBLICATIONS

Written Opinion of the International Searching Authority dated Aug. 16, 2018, received in corresponding US Application No. 2018/017669, 6 pages.

* cited by examiner

TRAINING AND CONTROLLING MULTIPLE FUNCTIONS OF A REMOTE DEVICE WITH A SINGLE CHANNEL OF A TRAINABLE TRANSCEIVER

CROSS-REFERENCES TO RELATED APPLICATIONS

This application claims the benefit and priority under 35 U.S.C. § 119(e) to U.S. Provisional Patent Application No. 62/457,509, titled "TRAINING AND CONTROLLING MULTIPLE FUNCTIONS OF A REMOTE DEVICE WITH A SINGLE CHANNEL OF A TRAINABLE TRANSCEIVER," filed Feb. 10, 2017, which is hereby incorporated by reference in its entirety.

TECHNICAL FIELD

The present disclosure relates generally to the field of transceivers for controlling remote electronic devices.

BACKGROUND

A transceiver may transmit various signals to control one of the functions of a remote electronic device (e.g., a garage door opener). The transceiver may have physical buttons, each of which may trigger the transmission of a command signal to actuate one function at the remote electronic device. One technical issue may be that assigning each function of the remote electronic device to separate physical buttons may result in fewer buttons available to control other functions of the remote electronic device or other, multiple electronic devices.

SUMMARY

At least one aspect of the present disclosure relates to a trainable transceiver for training and controlling multiple functions with a single channel. The trainable transceiver may include a channel, a training module, and a button. The channel may be configured to control a first function of a remote device. The training module may be configured to determine that a second function of the remote device satisfies a message similarity condition with the first function. The training module may be configured to train the channel to control both the first function and the second function responsive to the determination. The button may be configured to cause the channel to control one or more functions of the remote device alternately responsive to pressing of the button. The one or more functions may include the first function and the second function.

In some embodiments, the trainable transceiver may further include a comparator module. The comparator module may be configured to determine that the first function and the second function satisfies the message similarity condition by determining that a first control signal for actuating the first function has a first frequency similar to a second frequency of a second control signal for actuating the second function. The training module may be further configured to train the channel to control both the first function and the second function responsive to the determination that the first frequency is similar to the second frequency.

In some embodiments, the trainable transceiver may further include a comparator module. The comparator module may be configured to determine that the first function and the second function satisfies the message similarity condition by determining that a first control signal for actuating the first function includes a first number of pulses equal to a second number of pulses of a second control signal for actuating the second function. The training module may be further configured to train the channel to control both the first function and the second function responsive to the determination that the first number of pulses is equal to the second number of pulses.

In some embodiments, the trainable transceiver may further include a comparator module. The comparator module may be configured to determine that the first function and the second function satisfies the message similarity condition by determining that a first control signal for actuating the first function includes a first symbol sequence that differs from a second symbol sequence of a second control signal for actuating the second function by less than or equal to a predetermined threshold number of symbols. The training module may be further configured to train the channel to control both the first function and the seam function responsive to the determination that the first symbol sequence differs from the second symbol sequence by less than or equal to the predetermined threshold number of symbols.

In some embodiments, the trainable transceiver may further include a comparator module. The comparator module may be configured to determine that the first function and the second function satisfies the message similarity condition by determining that a first control signal for actuating the first function is of a same code type as a second control signal for actuating the second function. The training module may be further configured to train the channel to control both the first function and the second function responsive to the determination that the first control signal and the second control signal are of the same code type.

In some embodiments, the button may be configured to cause, responsive to a button press of a time duration longer than a threshold duration, the training module to enter a training mode to train the channel to control both the first function and the second function. In some embodiments, the trainable transceiver may further include a first counter and a second. The first counter may maintain a first rolling code count for the first function and the second counter may maintain a second rolling code count for the second function, responsive to the training of the channel to control both the first function and the second function to a determination that a code type of the first function and the second function is rolling code.

At least one aspect of the present disclosure relates to a system for training and controlling multiple functions with a single channel. The system may include a channel of a transceiver, a button, and a training module. The channel may be configured to be trained to control one or more functions of a remote device. The button may be configured to control actuation of the one or more functions trained to the channel and training of the channel of the transceiver. The training module may be configured to train the channel to control a first function of the remote device using a first control signal from an original transmitter, responsive to a first button press of the button. The training module may be configured to determine that a second function of the remote device satisfies a message similarity condition with the first function, responsive to a second button press subsequent to the first button press. The training module may be configured to train the channel to control both the first function and the second function of the remote device using a second control signal from the original transmitter, responsive to the determination that the second function satisfies the message similarity condition with the first function In some embodiments, the training module may be further configured to identify a number of functions trained to be controlled by the channel. In some embodiments, the training module may be further configured to compare the number of functions to a predetermined threshold number of functions. In some embodiments, the training module may be further configured to train the channel to control the second function of the remote device, responsive to the determination that the number of functions trained to be controlled by the channel is less than the predetermined threshold number of functions.

In some embodiments, the training module may be further configured to cause an electronic display coupled to the transceiver to render a prompt for adding the second function to the channel, responsive to the determination that the second function satisfies the message similarity condition with the first function. In some embodiments, the training module may be further configured to train the channel to control both the first function and the second function, responsive to receipt of an affirmative response to the prompt rendered on the electronic display.

In some embodiments, the training module may be further configured to determine that a third function of the remote device does not satisfy the message similarity condition with the first function, responsive to a third button press subsequent to the second button press. In some embodiments, the training module may be further configured to train the channel to control the third function of the remote device while overwriting the first function and the second function using a third control signal from the original transmitter, responsive to the determination that the third function does not satisfy the message similarity condition with the first function.

In some embodiments, the channel may be further configured to transmit the first control signal for actuating the first function or the second control signal for actuating the second function based on a time duration of a third button press.

In some embodiments, the system may further include a comparator module. The comparator module may be configured to compare a first message characteristic of the first control signal for actuating the first function and a second message characteristic of the second control signal for actuating the second function. The comparator module may be configured to determine whether the first function and the second function satisfy the message similarity condition based on the comparison between the first message characteristic and the second message characteristic.

At least one aspect of the present disclosure relates to a method for training and controlling multiple functions with a single channel. A trainable transceiver may detect a button press on a command button corresponding to a channel. The channel may be configured to be trained to control one or more functions of a remote device. The trainable transceiver may identify the channel as trained to control a first function of the remote device, responsive to detecting the button press on the command button. The trainable transceiver may determine that a second function of the remote device satisfies a message similarity condition with the first function. The trainable transceiver may train the channel to control both the first function and the second function, responsive to determining that the second function satisfies the message similarity condition with the first function. The trainable transceiver may configure the command button to transmit control signals to alternately actuate the first function and the second function of the remote device responsive to successive button presses.

In some embodiments, detecting the button press on the command button may further include determining that a time duration of the button press is greater than a predetermined time threshold. In some embodiments, training the channel to control both the first button and the second button may further include training the channel, responsive to determining that the time duration is greater than the predetermined time threshold.

In some embodiments, determining that the second function satisfies the message similarity condition with the first function may further include identifying a first message characteristic of a first control signal for actuating the first function of the remote device. In some embodiments, determining that the second function satisfies the message similarity condition with the first function may further include identifying a second message characteristic of a second control signal for actuating the second function of the remote device, some embodiments, the trainable transceiver may determining that the second function satisfies the message similarity condition with the first function may further include determining that the first message characteristic is similar to the second message characteristic.

In some embodiments, training the channel to control both the first function and the second function may further include determining that a first control signal for actuating the first function is of a same code type as a second control signal for actuating the second control type. In some embodiments, training the channel to control both the first function and the second function may further include initiating a counter for the channel to maintain a rolling code count for both the first function and the second function.

In some embodiments, training the channel to control both the first function and the second function may further include determining that training of the channel to control the second function fails. In some embodiments, training the channel to control both the first function and the second function may further include retraining the channel to control the second function, subsequent to determining that the training of the channel to control the second function failed.

In some embodiments, the trainable transceiver may detect a second button press on the command button subsequent to the button press. In some embodiments, the trainable transceiver may identify the channel as trained to control the first function of the remote device, responsive to detecting the second button press on the command button. In some embodiments, the trainable transceiver may determine that a third function of the remote device does not satisfy the message similarity condition with the first function. In some embodiments, the trainable transceiver may maintain the channel to control the first function, responsive to determining that the third function does not satisfy the message similarity condition.

In some embodiments, the trainable transceiver may transmit a first control signal for actuating the first function using the channel, responsive to a first button press of the command button. In some embodiments, the trainable transceiver may transmit a second control signal for actuating the second function using the channel, responsive to a second button press subsequent to the first button press.

Alternative exemplary embodiments relate to other features and combinations of features as may be generally recited in the claims.

DETAILED DESCRIPTION

Figure 1:
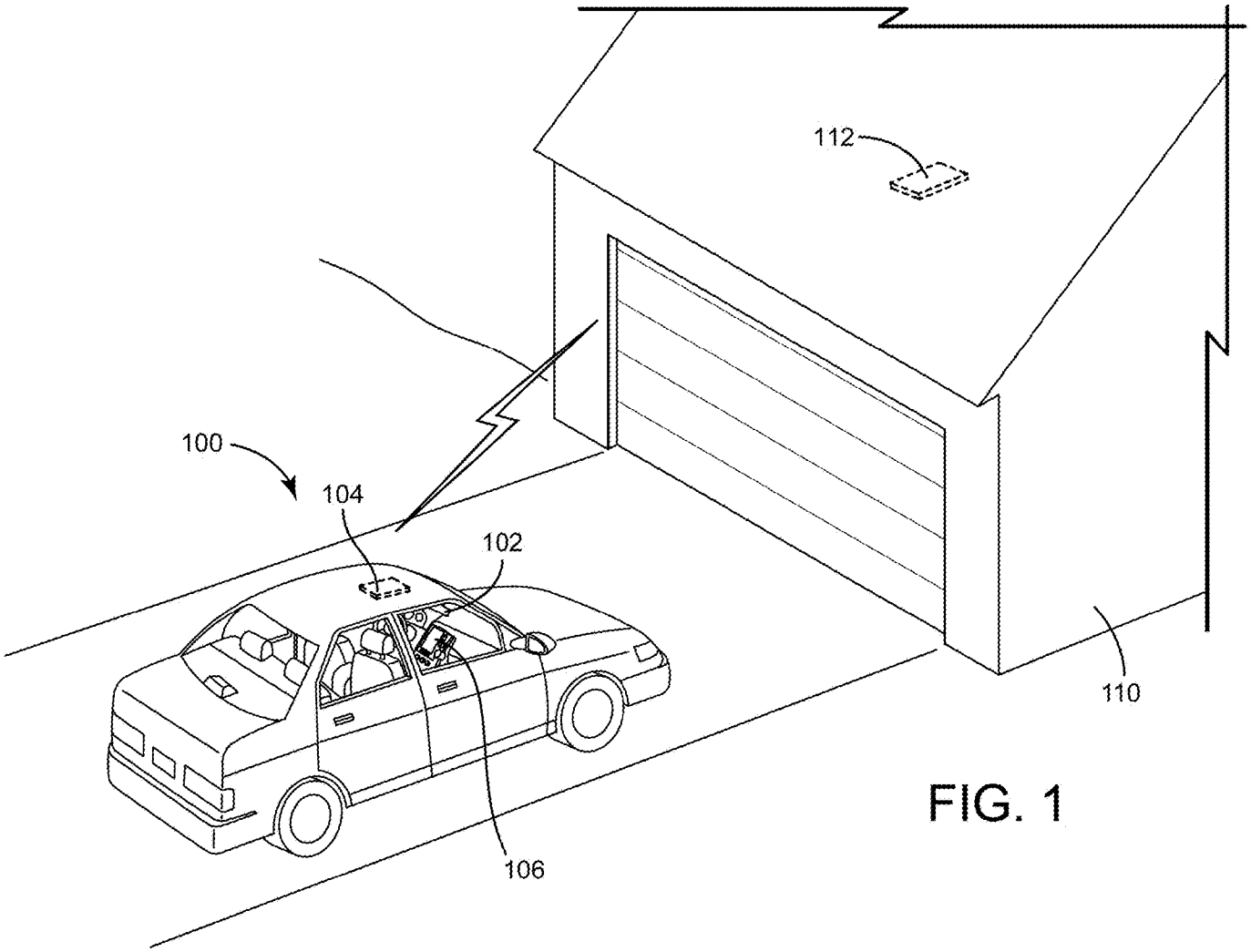
FIG. 1 is a perspective view of an embodiment of a vehicle having a trainable transceiver for operating a garage door after authenticating a user.

Referring generally to the FIGURES, systems, apparatuses, and methods are shown and described for allowing a trainable transceiver to train and control multiple commands to a single channel. A trainable transceiver may transmit various signals to control or actuate one of the functions at a remote electronic device (e.g., opening or closing a door). This disclosure allows for the trainable transceiver to assign or set multiple commands to a single channel to control the function of a remote electronic device. In one embodiment, the trainable transceiver may include a reconfigurable electronic display with a user interface including container elements with soft keys. The trainable transceiver may be trained to control multiple functions of the remote electronic device. While training, the trainable transceiver may determine that the remote electronic device utilizes multiple command codes (e.g., lock, unlock, activate, and enroll/pair). Upon the determination, the trainable transceiver may associate the multiple codes into a single channel. In addition, the user interface on the reconfigurable electronic display may display a prompt for assigning functions of the remote electronic device to one of the soft keys on the display. The trainable transceiver may also remove soft keys from display, if determined to be no longer pertinent or needed (e.g., pair command after pairing the trainable transceiver with the remote electronic device). In this manner, clear indications as to which function is associated with the soft key on the user interface of the trainable transceiver may reduce the likelihood that a command different from the one the operator of the trainable transceiver had intended will be sent. Moreover, associating multiple commands with a single channel of the trainable transceiver, instead of different channels, may free up other channels for other uses (e.g., controlling different remote electronic devices).

With respect to trainable transceivers for controlling home electronics device and/or remote devices in general, home electronic devices may include devices such as a garage door opener, gate opener, lights, security system, and/or other device which is configured to receive activation signals and/or control signals. A home electronic device need not be associated with a residence but can also include devices associated with businesses, government buildings of locations, or other fixed locations. Remote devices may include mobile computing devices such as mobile phones, smartphones, tablets, laptops, computing hardware in other vehicles, and/or other devices configured to receive activation signals and/or control signals.

Activation signals may be wired or, preferably, wireless signals transmitted to a home electronic device and/or remote device. Activation signals may include control signals, control data, encryption information (e.g., a rolling code, rolling code seed, look ahead codes, secret key, fixed code, or other information related to an encryption technique), or other information transmitted to a home electronic device and/or remote device. Activation signals may have parameters such as frequency or frequencies of transmission (e.g., channels), encryption information (e.g., a rolling code, fixed code, or other information related to an encryption technique), identification information (e.g., a serial number, make, model or other information identifying a home electronic device, remote device, and/or other device), and/or other information related to formatting an activation signal to control a particular home electronic device and/or remote device.

In some embodiments, the trainable transceiver receives information from one or more home electronic devices and/or remote devices. The trainable transceiver may receive information using the same transceiver used to send activation signals and/or other information to home electronic devices and/or remote devices. The same wireless transmission scheme, protocol, and/or hardware may be used for transmitting and receiving. The trainable transceiver may have a two way communication with home electronic devices and/or remote devices. In other embodiments, the trainable transceiver includes additional hardware for two way communication with devices and/or receiving information from devices. In some embodiments, the trainable transceiver has only one way communication with a home electronic device. The trainable transceiver may receive information about the home electronic device from a remote device in a separate communication. The information about the home electronic device and/or remote device may be received from an intermediary device such as an additional remote device and/or mobile communication device.

A trainable transceiver may also receive information from and/or transmit information to other devices configured to communicate with the trainable transceiver. In some embodiments, trainable transceiver may receive information from cameras (e.g., imaging information may be received) and/or other sensors. The cameras and/or other sensors may communicate with a trainable transceiver wirelessly (e.g., using one or more transceivers) or through a wired connection. In some embodiments, a trainable transceiver may communicate with mobile communications devices (e.g., cell phones, tablets, smartphones, or other communication devices). In some embodiments, mobile communications devices may include other mobile electronics devices such as a global positioning system or other navigation devices, laptops, personal computers, and/or other devices. In still further embodiments, the trainable transceiver is configured to communicate with networking equipment such as routers, servers, switches, and/or other hardware for enabling network communication. The network may be the internet and/or a cloud architecture.

The trainable transceiver transmits and/or receives information (e.g., activation signals, control signals, control data, status information, or other information) using a radio frequency signal. For example, the transceiver may transmit and/or receive radio frequency signals in the ultra-high frequency range, typically between 260 and 960 megahertz (MHz), although other frequencies may be used. In other embodiments, a trainable transceiver may include additional hardware for transmitting and/or receiving signals (e.g., activation signals and/or signals for transmitting and/or receiving other information). In some embodiments, a trainable transceiver may include a light sensor and/or light emitting element, a microphone and/or speaker, a cellular transceiver, an infrared transceiver, or another communication device.

The trainable transceiver may be trained by a user to work with particular remote devices and/or home electronic devices (e.g., a garage door opener). In some embodiments, a user may manually input control information into the trainable transceiver to configure the trainable transceiver to control the device. A trainable transceiver may also learn control information from an original transmitter. A trainable transceiver may receive a signal containing control information from an original transmitter (e.g., a remote sold with a home electronic device) and detect the control information of the received signal. In some embodiments, an original transmitter is a transmitter produced by the manufacturer of home electronics device, remote device, or other device for use specifically with the corresponding device. An original transmitter may be a transmitter which is sold separately from a home electronics device, remote device, or other device but is intended to work with that device. The original transmitter may be a transmitter or transceiver that is part of a retrofit kit to add functions to an existing home electronics device, remote device, or other device. An original transmitter may be a transmitter or transceiver that is not manufactured by or under license from the manufacturer or owner of a home electronics device, remote device, or other device.

Referring to FIG. 1, a perspective view of a vehicle 100 and garage 110 is shown, according to an exemplary embodiment, Vehicle 100 may be an automobile, truck, sport vehicle, or other vehicle. Vehicle 100 is shown to include a trainable transceiver unit 102. In some embodiments, trainable transceiver unit 102 may be integrated with a mirror assembly (e.g., a rear view mirror assembly) of vehicle 100. In other embodiments, trainable transceiver unit 102 may be mounted to other vehicle interior elements, such as a vehicle headliner 104, a center stack 106, a visor, an instrument panel, or other control unit within vehicle 100.

Trainable transceiver unit 102 is configured to communicate with a remote electronic system 112 of a garage 110 or other structure. In some embodiments, remote electronic system 112 is configured to control operation of a garage door attached to garage 110. In other embodiments, remote electronic system 112 may be a home lighting system, a home security system, a data network (e.g., using ASK, using OOK, using FSK, LAN, WAN, cellular, etc.), a HVAC system, or any other remote electronic system capable of receiving control signals from trainable transceiver unit 102.

Trainable transceiver unit 102 is configured to reduce a duty cycle of a received activation signal relative and increase radio frequency power of subsequent transmissions of activation signals based on the received activation signal, while maintaining, an average radio frequency power over a predetermined amount of time below a predetermined limit. This provides an advantage in that trainable transceiver unit 102 has a greater range allowing for users in vehicle 100 to control remote electronic systems 112 (e.g., a garage door opener) from a greater distance.

Figure 2:
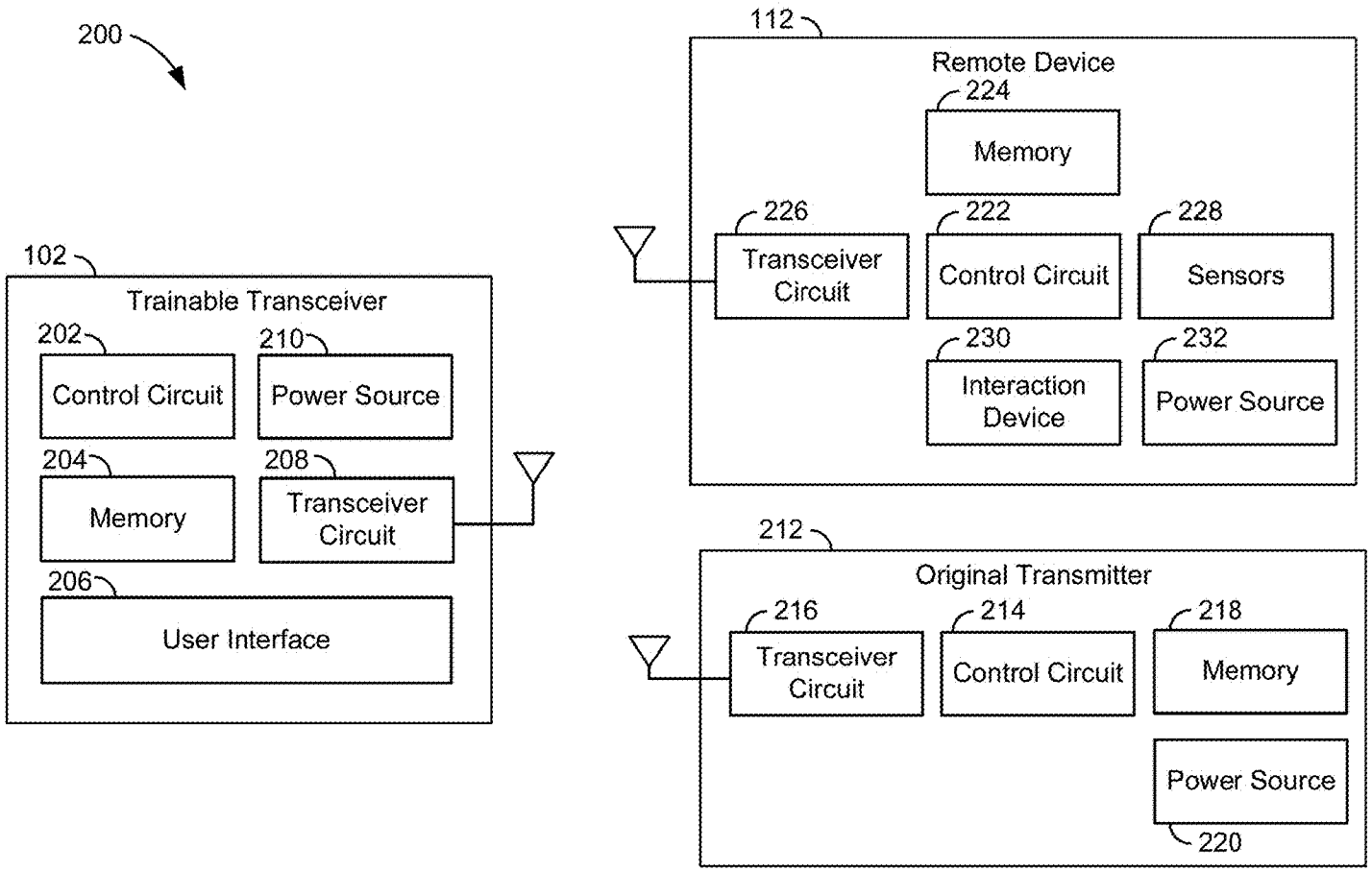
FIG. 2 is a block diagram of a trainable transceiver and the external devices with which the trainable transceiver can communicate, according to an illustrative embodiment.

Referring now to FIG. 2, a block diagram of the trainable transceiver 102, remote device 112, and an original transmitter 212 are shown, according to an illustrative embodiment. In overview, the trainable transceiver 102 may include a control circuit 202, memory 204, a user interface 206, a transceiver circuit 208, and a power source 210, among other components. The remote device 112 may include a control circuit 222, memory 224, a transceiver circuit 222, a sensor 238, an interaction device 230, and a power source 232. The original transmitter 212 may include a control circuit 214, a transceiver circuit 216, memory 218, and a power source 220.

The control circuit 202 of the trainable transceiver 102 may be configured to receive inputs from the user interface 206. In response to inputs from the user interface 206, the control circuit 202 may cause the transceiver circuit 208 to transmit an activation signal, control signal, and/or other signal. The control circuit 202 may use information in memory 204 in order to cause the transceiver circuit 208 to format a signal for reception by a particular home electronics device or remote device 112. In some embodiments, the memory 204 may include an identifier of the device, encryption information, frequencies for use in transmitting to the device, and/or other information.

The control circuit 202 may include various types of control circuitry, digital and/or analog, and may include a microprocessor, microcontroller, application-specific integrated circuit (ASIC), graphics processing unit (GPU), or other circuitry configured to perform various input/output, control, analysis, and other functions to be described herein. In other embodiments, the control circuit 202 may be a system on a chip (SoC) individually or with additional hardware components described herein. The control circuit 202 may further include, in some embodiments, memory 204 (e.g., random access memory, read only memory, flash memory, hard disk storage, flash memory storage, solid state drive memory, etc.). In further embodiments, the control circuit 202 may function as a controller for one or more hardware components included in the trainable transceiver. In some embodiments, the control circuit 202 may function as a controller for a machine-human interface (e.g., user interface 206) or other operator input device, a controller for a transceiver, transmitter, receiver, or other communication device (e.g., implement a Bluetooth communications protocol).

The control circuit 202 may be coupled to memory 204. The memory 204 may be used to facilitate the functions of the trainable transceiver 102 described herein. Memory 204 may be volatile and/or non-volatile memory. The memory 204 may be random access memory, read only memory, flash memory, hard disk storage, flash memory storage, solid state drive memory, etc. In some embodiments, the control circuit 202 may read and write to memory 204. Memory 204 may include computer code modules, data, computer instructions, or other information which may be executed by the control circuit or otherwise facilitate the functions of the trainable transceiver described herein. The memory 204 may include encryption codes, pairing information, identification information, a device registry, etc. Memory 204 may include computer instructions, codes, programs, functions, data sets, and/or other information which are used to implement the algorithms described herein.

The control circuit 202 may also receive inputs via the user interface 206 and in response place the trainable transceiver into a training mode. While in the training mode, an activation signal transmitted by the original transmitter 212 may be received by the transceiver circuit 208 of the trainable transceiver 102. The control circuit 202 of the trainable transceiver 102 may store one or more characteristics of the received activation signal in memory 204 for use in formatting control signals to be sent using the transceiver circuit 208. In some embodiments, stored characteristics may include, information identifying a home electronics device or remote device 112, encryption information, frequency, and/or other characteristics of the activation signal sent by the original transmitter 212 and received by the transceiver circuit 208 of the trainable transceiver 102. In some embodiments, the control circuit 202 may cause the user interface 206 to provide an output (e.g., illuminate an LED) when the signal from the original transmitter 212 is received and one or more characteristics are store in memory 204.

The transceiver circuit 208 allows the trainable transceiver 102 to transmit and/or receive wireless communication signals. Wireless communication signals may be or include activation signals, control signals, activation signal parameters, status information, notifications, diagnostic information, training information, instructions, and/or other information. The wireless communication signals may be transmitted to or received from a variety of wireless devices (e.g., an original transmitter, home electronic device, mobile communications device, and/or remote device). The transceiver circuit 208 may be controlled by the control circuit 202. In some embodiments, the control circuit 202 may turn on or off the transceiver 208, the control circuit 202 may send data using the transceiver 208, format information, an activation signal, control and/or other signal or data for transmission via the transceiver circuit 208, or otherwise control the transceiver circuit 208. In some embodiments, the transceiver circuit 208 may include additional hardware such as processors, memory, integrated circuits, antennas, etc. The transceiver circuit 208 may process information prior to transmission or upon reception and prior to passing the information to the control circuit 202. In some embodiments, the transceiver circuit 208 may be coupled directly to memory 204 (e.g., to store encryption data, retrieve encryption data, etc.).

The trainable transceiver 102 includes a transceiver circuit 208 and/or one or more antennas included in or coupled to the transceiver circuit 208. The antenna(s) may be located in the same housing and/or same location as other components of the trainable transceiver 102 (e.g., the transceiver circuit 208, control circuit, operator input device, and/or other components). In alternative embodiments, the antenna(s) are located remotely from one or more components of the trainable transceiver 102. The antenna(s) may be coupled to other components of the trainable transceiver 102 (e.g., transceiver circuit 208, control circuit, power source, and/or other components) via a wired or wireless connection. In some embodiments, the antenna and/or transceiver circuit 208 may be located remotely from the operator input device and control circuit with the control circuit in wireless communication with the transceiver circuit 208 via the antenna coupled to the transceiver circuit 208 and a second antenna coupled to the control circuit. The antenna may be one or a combination of a variety of antenna types. The antenna may be or include a dipole antenna, loop antenna, slot antenna, parabolic reflector, horn, monopole, helical, and/or other type of antenna. The antenna may be omnidirectional, weakly directional, or directional. The antenna(s) and/or transceiver circuit 208 may be used to retrieve image data from one or more sources. The antenna(s) and/or transceiver circuit 208 may further be used for controlling a home electronics device, remote device 112, or other device (e.g., by sending an activation signal formatted by the control circuit and/or transceiver circuit 208 to control the device).

The transceiver circuit 208 may include one or more transceivers, transmitters, receivers, etc. The transceiver circuit 208 may include an optical transceiver, near field communication (NFC) transceiver, etc. In some embodiments, the transceiver 208 may be implemented as a system on a chip. The transceiver circuit 208 may be used to format and/or send activation signals to a device, causing the device to take an action and/or otherwise allows communication with the device. The activation signal may include activation signal parameters and/or other information. The transceiver circuit 208 may be or include a radio frequency transceiver (e.g., a transceiver which sends or receives wireless transmission using radio frequency electromagnetic radiation). The transceiver circuit 208 and/or control circuit 202 may modulate radio waves to encode information onto radio frequency electromagnetic radiation produced by the transceiver circuit 208 and/or demodulate radio frequency electromagnetic radiation received by the transceiver circuit 208.

The transceiver circuit 208 may include additional hardware such as one or more antennas, voltage controlled oscillator circuitry, amplifiers, filters, antenna tuning circuitry, volt meters, and/or other circuitry for the generation of and/or reception of modulated radio waves of different frequencies. The transceiver circuit 208 may provide for the functions described herein using techniques such as modulation, encoding of data onto a carrier wave, decoding data from a modulated carrier wave, signal strength detection, (e.g., computing and/or measuring voltage per length received by an antenna), antenna power regulation, and/or other functions related to the generation of and/or reception of radio waves. In some embodiments, the transceiver circuit 208 may be used to generate a carrier wave and encode onto the carrier wave (e.g., through modulation of the carrier wave such as frequency modulation or amplitude modulation) information such as control data, activation signal parameters, an encryption code (e.g., rolling code value), and/or other information. The transceiver circuit 208 may also be used to receive carrier waves and demodulate information contained within the carrier wave. The trainable transceiver 102 may be tuned (e.g., through antenna tuning) or otherwise controlled to send and/or receive radio waves (e.g., modulated carrier waves) at certain frequencies or channels and/or with a certain bandwidth.

The user interface 206 may include a series of buttons and an illuminable logo, design, light, or other feature. Each button may be trained to operate a different home electronics device and/or remote device 112 using one or more of the training procedures described herein. In some embodiments, each button may be a physical mechanical button configured to trigger the control circuit 202 to control the remote device 112 upon a press or other interaction with the button. In some embodiments, each button may be a soft key on an electronic display configured to trigger the control circuit 202 to control the remote device 112 upon interaction with the soft key. The illuminable feature of the user interface 206 may be used to communicate information to the user of the trainable transceiver 102. The user interface 206 may include a display, one or more LEDs, a speaker, and/or other output devices for providing an output to a vehicle occupant. The output may convey information to the vehicle occupant regarding the position of the vehicle within a garage, structure, and/or designated parking area. In some embodiments, the user interface element 206 may include a reconfigurable electronic display that may be touch-sensitive.

The user interface 206 may be located remotely from one or more other components of the trainable transceiver 102 in some embodiments. In embodiments in which the trainable transceiver 102 is installed in or otherwise integrated with a vehicle, the user interface 206 may be located within the cabin of the vehicle, and one or more other components of the trainable transceiver 102 may be located in other locations (e.g., in an engine bay, in a trunk, behind or within a dashboard, in a headliner, elsewhere in the cabin and/or in other locations). This may allow for installation of the trainable transceiver 102, including the antenna, in a variety of locations and/or orientations. Advantageously, this may allow for the antenna(s) of the trainable transceiver 102 to be installed, mounted, or otherwise located in or on the vehicle in a position with less interference from vehicle structural components.

The user interface 206 and other components of the trainable transceiver 102 may be in unidirectional or bidirectional communication with each other. The user interface 206 may communicate via wire or wirelessly with the remaining components of the trainable transceiver 102 in some embodiments. In some embodiments, the user interface 206 may be connected via a wire with the remaining components of the trainable transceiver 102. In some embodiments, the user interface 206 may include a transceiver for transmitting signals corresponding to inputs received and for receiving status or other information to be conveyed to a vehicle occupant. The user interface 206 may include a wireless transceiver (e.g., WiFi transceiver, Bluetooth transceiver, optical transceiver, and/or other transceiver) configured to communicate with the other components using the transceiver circuit 208 and/or a second transceiver (e.g., WiFi transceiver, Bluetooth transceiver, optical transceiver, and/or other transceiver) located with the other components remote from the operator input device. Communication between the trainable transceiver 102 and the operator input device may be carried out using one or more wireless communication protocols (e.g., a Bluetooth protocol, WiFi protocol, ZigBee protocol, or other protocol). The other components of the trainable transceiver 102 may communicate with the operator input device using the transceiver circuit 208 and/or a secondary or other transceiver (e.g., a Bluetooth transceiver).

The trainable transceiver 102 may communicate with original transmitters 212, home electronic devices 112, remote devices, mobile communications devices, network devices, and/or other devices as described above using the transceiver circuit 208 and/or other additional transceiver circuits or hardware. The devices with which the trainable transceiver 102 communicates may include transceivers, transmitters, and/or receivers. The communication may be one-way or two-way communication.

The power source 210 may also be included in the trainable transceiver 102 in some embodiments. The control circuit 202 may control the power source 210 such that the antenna and/or transceiver circuit 208 is provided with an amount of power determined based on the orientation of the trainable transceiver 102. In one embodiment, the power source 210 may be or may include a vehicle power system. The power source may be a vehicle power system including a battery, alternator or generator, power regulating equipment, and/or other electrical power equipment. In further embodiments, the power source 210 may include components such as a battery, capacitor, solar cell, and/or other power generation or storage equipment.

The trainable transceiver 102 may be configured to be trained to control a home electronics device and/or remote device, such as the remote device 112. A home electronics device and/or remote device 112 may be any remotely controlled device. Home electronics device and/or remote devices 112 may include garage door openers, lighting control systems, movable barrier systems (e.g., motorized gates, road barriers, etc.), multimedia systems, and/or other systems controllable by an activation signal and/or control signal. Home electronics devices and/or remote devices may include an antenna and a receiver or transceiver circuit 226 for receiving transmissions from the trainable transceiver 102 and/or an original transmitter 212. Home electronics devices and/or remote devices may also include a control circuit 222 and/or memory 224 for processing the received signal. An activation signal from a trainable transceiver 102 or original transmitter 212 may be received by an antenna and receiver circuit of the transceiver circuit 226. The control circuit 222 may determine whether encryption information transmitted as part of the activation signal matches an expected value. The control circuit 222 may cause an interaction device 230 to activate. For example, the Home electronics devices and/or remote devices may be a garage door opener and the interaction device may be a motor for opening and/or closing the garage door. Upon receipt of the activation signal at the transceiver 226 or receiver circuit, the control circuit 222 may activate the motor after determining that the activation signal included valid encryption information such as a key value.

The home electronics device or remote device 112 may include hardware components for communication with a trainable transceiver 102 or original transmitter 212. In some embodiments, the home electronics device or remote device 112 includes a transceiver circuit 208. The transceiver circuit 208 may be used to send and/or receive wireless transmissions. In some embodiments, the transceiver circuit 208 may be or include a transceiver which sends and/or receives radio frequency electromagnetic signals. The transceiver circuit 208 may allow a home electronics device or remote device 112 to receive an activation signal and/or other transmission from a trainable transceiver 102 or original transmitter 212. In some embodiments, a trainable transceiver 102 may transmit an activation signal using activation signal parameters acquired as part of a training process. The home electronics device or remote device 112 may receive the activation signal using a transceiver circuit 208. The transceiver circuit 208 may be configured to transmit signals to a trainable transceiver 102, original transmitter 212, and/or other device. For example, the home electronics device or remote device 112 may transmit status information (e.g., that a garage door is closed) or other information. In some embodiments, the trainable transceiver 102 is configured to send and/or receive signals using multiple channels (e.g., a plurality of frequencies of radio waves used for communication). The transceiver circuit 208 of the home electronics device or remote device 112 may function in the same or similar manner as described with reference to the transceiver circuit 208 of the trainable transceiver 102.

The home electronics device or remote device 112 includes memory 224 and/or a control circuit 222 in some embodiments. The memory 224 and/or a control circuit 222 may facilitate and/or carry out the functions of the home electronics device or remote device 112 described herein. The control circuit 222 and/or memory 224 may be the same or similar to the control circuit 202 and/or memory 204 described with respect to the trainable transceiver 102. In some embodiments, the control circuit 222 may be or include a processor and the memory 224 may be or include volatile (e.g., flash memory) and/or non-volatile memory (e.g., hard disk storage). The control circuit 222 may carry out computer programs, instructions, and/or otherwise use information stored in memory 224 to perform the functions of the home electronics device or remote device 112. The control circuit 222 and memory 224 may be used to process an activation signal (e.g., perform encryption related tasks such as comparing a received key with a stored key, handling instructions included in the signal, executing instructions, processing information, and/or otherwise manipulating or handling a received signal) received by the transceiver circuit 208 and/or control an interaction device in response to the activation signal.

The home electronics device or remote device 112 may further include an interaction device 230. The interaction device 230 may allow the home electronics device or remote device 112 to interact with another device, component, other hardware, the environment, and/or otherwise allow the home electronics device or remote device 112 to affect itself or something else. The interaction device 230 may be an electrical device such as a light, transceiver, or networking hardware. The interaction device 230 may also or alternatively be an electromechanical device such as electric motor, solenoid, or other hardware. The home electronics device or remote device 112 (e.g., a garage door opener) may transmit a signal to a trainable transceiver 102 or original transmitter 212 from which the activation signal originated. The transmission may include information such as receipt of the activation signal, status information about the garage door opener or associated hardware (e.g., the garage door is closed), and/or other information.

Home electronics devices and/or remote devices 112 may include a power source 232 for powering the interaction device 230 and/or other components. For example, the power source 232 may be a connection to a home, office, or other structure's power system (e.g., one or more circuits drawing power from mains power). The power source 232 may be or include other components such as a battery.

In further embodiments, home electronics devices and/or remote devices 112 may include additional components such as sensors 228. Sensors 228 may be or include cameras, light sensors, motion sensors, garage door position sensors, and/or other sensors. Home electronics devices and/or remote devices 112 may use a transceiver circuit 226 to transmit information from or determined based on the sensors 228 to the trainable transceiver 102. The trainable transceiver 102 may display this information using the user interface 206. Sensors 228 may be used by the device to monitor itself, the environment, hardware controlled by the device, and/or otherwise to provide information to the device. Sensors 228 may provide status information to the device. In some embodiments, sensors 228 may be or include, temperature sensors (e.g., thermistor, thermocouple, or other hardware for measuring temperature), movement or acceleration sensors (e.g., accelerometers, inclinometers, or other sensors for measuring orientation, movement, or a derivative thereof), safety beams (e.g., sensors which detect when an infrared, or other spectrum, beam of light is broken by an object), sensor which detect distance (e.g., an ultrasound emitter and receiver configured to determine distance of an object), pressure sensors (e.g., pressure transducer, strain gauge, etc.), or other sensor. In some embodiments, one or more sensors 228 may be configured to determine the status of a garage door opener or garage door. For example, a pressure sensor may be used to determine if a garage door is closed (e.g., in contact with the ground and/or sensor.

Home electronics devices and/or remote devices 112 may be sold with or otherwise be associated with an original transmitter 212. An original transmitter 212 may be a transmitter provided by the manufacturer of the home electronics devices and/or remote devices 112 for wirelessly controlling the home electronics devices and/or remote devices 112. In alternative embodiments, the original transmitter 212 may be a transmitter sold separately from the home electronics device and/or remote device 112 which is configured to control the home electronics device and/or remote device 112. For example, the original transmitter 212 may be a retrofit product, trainable transceiver 102, and/or other transmitter configured to control the home electronics device and/or remote device 112.

The original transmitter may 212 include a transceiver circuit 216, control circuit 214, memory 218, power source 220, and/or other components. The transceiver circuit 216 may be a transceiver or transmitter and may be coupled to and/or include an antenna. The control circuit 214 may control the transceiver to format and transmit an activation signal and/or control signal based on information stored in memory 218 (e.g., device identification information, encryption information, frequency, and/or other information). The control circuit 214 may also handle inputs received from an operator input device such as button included in the original transmitter 212. The original transmitter may have a power source 220 such as a battery.

The original transmitter 212 may include a transceiver circuit 216. As described with reference to the trainable transceiver 102, the transceiver circuit 216 of the original transmitter 212 may allow the original transmitter 212 to send transmissions to an associated device (e.g., home electronics device or remote device 112) and/or receive transmissions from an associated device. For example, an original transmitter 212 may send an activation signal to an associated device and/or may receive status information and/or other information from the associated device.

The original transmitter 212 may include a control circuit 214 and/or memory 218. The control circuit 214 and/or memory 218 may facilitate the functions of the original transmitter 212 in the same or similar fashion as described with reference to the trainable transceiver 102. For example, the control circuit 214 may receive a user input from an operator input device (e.g., button). The control circuit 214 may cause the transceiver circuit 216 to transmit an activation signal in response. One or more activation signal parameters may be read by the control circuit 214 from memory 218. For example, the memory 218 of the original transmitter 212 may be non-volatile and store activation signal parameters for an associated device such as a frequency used to receive or send transmissions, frequencies used for the same, channels used for the same, encryption information (e.g., rolling code values, a seed value, etc.), device identification information, modulation scheme, and/or other information.

The transceiver circuit 208 of the trainable transceiver 102 and the transceiver circuit 226 of the home electronics device, remote device 112, original transmitter 212, and/or other device may be configured to communicate send and/or receive wireless signals (e.g., activation signals, communication signals, and/or other signals). This may allow for communication between the trainable transceiver 102 and other device. In one embodiment, the transceiver circuits may be configured to transmit and/or receive radio frequency transmissions. Communication between the trainable transceiver 102 and other device may be unidirectional or bi-directional. In some embodiments, the trainable transceiver 102 and/or other device may be configured to communicate using multiple frequencies. Each frequency may be a channel used for communication. A home electronics device, remote device 112, original transmitter 212, or other device may be configured to communicate using multiple channels for sending and/or receiving radio frequency transmissions using a transceiver Wet 214. For example, a home electronics device (e.g., garage door opener) may be configured to communicate using multiple channels in the 900 MHz band. Continuing the example, a first channel may be 903.925 MHz and a second channel may be 904.075 MHz. In some embodiments, a single channel is used for transmission and/or reception. In other embodiments, a plurality of channels (e.g., two or more channels) may be used for communication by the home electronics device, remote device 112, original transmitter 212, and/or other device.

The trainable transceiver 102 may be trained to use the same plurality of channels or single channel thereby allowing the trainable transceiver 102 to communicate with the device. The trainable transceiver 102 may be trained (e.g., through a training procedure) to send and/or receive radio frequency transmissions using the channel(s) the device is configured to use for transmitting and/or receiving transmissions. The trainable transceiver 102 may store the channel information and/or other information as activation signal parameters for use with the corresponding device. The trainable transceiver 102 may store activation signal parameters (including channel frequencies used by the device) for one or more devices. Using the control circuit, memory, and/or transceiver circuit 214, the trainable transceiver 102 may format activation signals for a plurality of devices. This allows a single trainable transceiver 102 to control a plurality of devices depending on the user input. For example, a trainable transceiver 102 may receive a first user input and format a first activation signal for the device corresponding to a first device associated with the user input. The first activation signal may include or use a first channel or group of channels associated with the first device. This may allow the first device to communicate with the trainable transceiver 102 using a plurality of channels. Continuing the example, a trainable transceiver 102 may receive a second user input and format a second activation signal for the device corresponding to a second device associated with the user input. The second activation signal may include or use a second channel or group of channels associated with the second device. This may allow the second device to communicate with the trainable transceiver 102 using a plurality of channels.

A trainable transceiver 102 may be trained to an existing original transmitter 212 such that the trainable transceiver 102 controls the device associated with the original transmitter 212. For example, a user may place the trainable transceiver 102 and original transmitter 212 such that the trainable transceiver 102 is within the transmission range of the original transmitter 212. The user may then cause the original transmitter 212 to send an activation signal or other transmission (e.g., by depressing a button on the original transmitter 212). The trainable transceiver 102 may identify one or more activation signal parameters, the device, and/or other information based on the transmission from the original transmitter 212 which the trainable transceiver 102 may receive using the transceiver circuit 214. The control circuit, memory, and/or other transceiver circuit 214 may identify, determine, and or store information such as the frequency, frequencies, or channels used by the original transmitter 212 and therefore the device associated with the original transmitter 212, a control code or other encryption information, carrier frequency, bandwidth, and or other information.

In some embodiments, the home electronics device, remote device 112, or other device may be configured to learn an identifier, encryption information, and/or other information from a trainable transceiver 102. For example, the device may be placed in a learning mode during which time a user sends a transmission from the trainable transceiver 102 (e.g., by providing an input causing the transmission). The device may receive the transmission and perform a function in response. For example, the device may send an acknowledgement transmission in response to receiving the transmission, send a transmission including a ready indication (e.g., that the device is synchronized with the trainable transceiver 102, encryption information has been exchanged, communication has been acknowledged on all channels used by the device, etc.), store an identifier of the trainable transceiver 102, and/or perform other functions. This process may constitute a pairing of the trainable transceiver 102 and the home electronics device, remote device 112, or other device. For systems using a rolling code, the trainable transceiver 102 and device may be synchronized so that the counters of the trainable transceiver 102 and the device begin with the same rolling code value.

Figure 3A:
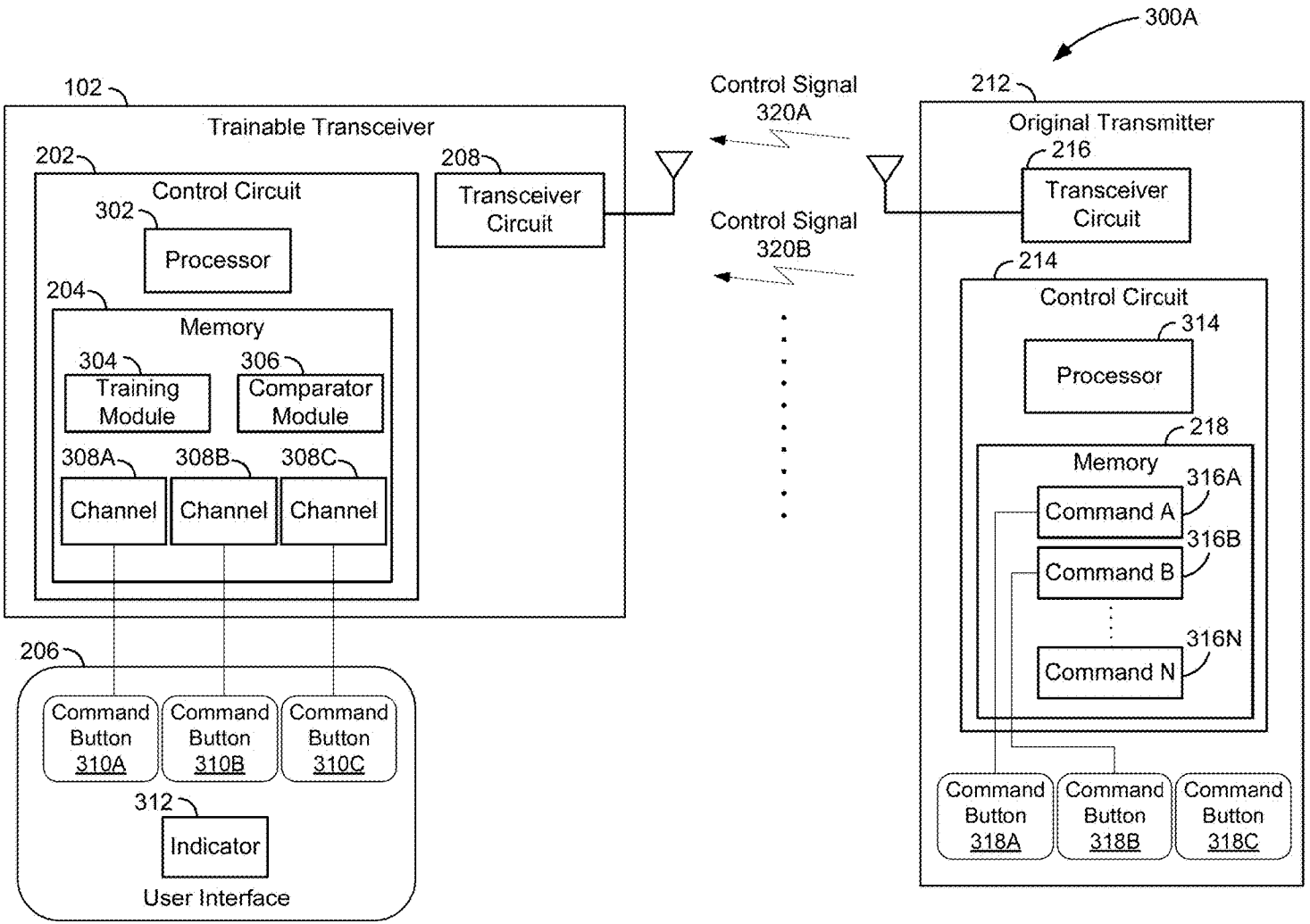
FIG. 3A is a block diagram of a system for training multiple functions with a single transceiver channel, according to an illustrative embodiment.

Referring now to FIG. 3A, a block diagram of the trainable transceiver 102 while in training mode in communication with the original transmitter 212 is shown, in accordance with an illustrative embodiment. The trainable transceiver 102 and the original transmitter 212 may include the components and features illustrated and described above with reference to FIG. 2. In addition, in the schema described in system 300A, the control circuit 202 of the trainable transceiver 102 may also include a processor 302. The memory 204 of the control circuit 202 may further include a training module 304, comparator module 306, and one or more channels 308A-308N. The user interface 206 may include one or more command buttons 310A-310N and an indicator 312. Each command button 310A-310N may correspond to one of the channels 308A-308N. For example, an interaction (e.g., push, press, etc.) with the first command button 310A may cause the trainable transceiver 102 to control the one or more functions trained at the first channel 308A. Furthermore, an interaction with the second command button 310B may cause the trainable transceiver 102 to control the one or more functions trained at the second channel 308B, and so forth.

In addition, the control circuit 214 of the original transmitter 212 may include a processor 314 and one or more command buttons 318A-318N. The memory 218 of the original transmitter 212 may include one or more commands 316A-316N. Each of the one or more commands 316A-316N may control a function of the remote device 112 (e.g., unlock, lock, open, and close a barrier, etc.). Each of the one or more commands 316A-316N may correspond to one of the command buttons 318A-318N. For example, an interaction with the first command button 318A may cause the original transmitter 212 to transmit a first control signal 320A corresponding to the first command 316A for controlling a first function at the remote device 112. Furthermore, an interaction with the second command button 318B may cause the original transmit 212 to transmit a second control signal 320B corresponding to the second command 316B for controlling a second function at the remote device 112, and so forth. The control signals 320A-320N transmitted by the original transmitter 212 via the transceiver circuit 216 may be used to train the trainable transceiver 102.

The control circuit 202 of the trainable transceiver 102 may include one or more modules in memory 204 for carrying out and/or facilitating the operation of the trainable transceiver 102 described herein. In some embodiments, the memory 204 of the control circuit 202 may include a training module 304, a comparator module 306, and the one or more channels 308A-308N in memory 204. The modules of the control circuit 202 may be executed or otherwise handled or implemented using a processor 302. The processor 302 may be a general or application specific processor or circuit for performing calculations, handling inputs, generating outputs, and/or otherwise performing computational tasks. In some embodiments, the modules (e.g., training module 304 and comparator module 306) may each be a general or application specific processor or circuit for performing the instructions specified therein.

The user interface 206 may include the one or more command buttons 310A-310N and the indicator 312. In some embodiments, each command button 310A-310N may be a physical mechanical button (e.g., a push-button, a physical switch, etc.). In some embodiments, each command button 310A-310N may be a touch-sensitive button on an electronic display (e.g., the screen on the vehicle center stack 106). Each command button 310A-310N may correspond to one channel 308A-308N. Pressing or interaction with one command button 310A-310N may trigger the control circuit 202 to execute or otherwise process the functionality of the corresponding channel 308A-308N. The indicator 312 may be used to indicate a status of the trainable transceiver 102 (e.g., success or failure to perform the requested operation). In some embodiments, the indicator 312 may be a light source, such as an incandescent light bulb, a laser-emitting diode, or an ASCII display, among others. In some embodiments, the indicator 312 may be an electroacoustic transducer, such as a loudspeaker, a buzzer, or a siren, among others. In some embodiments, the indicator 312 may be a graphical user interface element rendered and displayed on an electronic display. In some embodiments, the user interface 206 may be situated with the other components and/or modules of the trainable transceiver 102. In some embodiments, the user interface 206 may be situated away from the other components and/or modules of the trainable transceiver 102 (e.g., at the vehicle center stack 106, the visor, the instrument panel, or other control unit within vehicle 100).

The training module 304 may include instructions, programs, executable code, and/or other information used by the control circuit 202 to perform training functions. The training module 304 may learn control information from the original transmitter 212 to control a function of the remote device 112. The training module 304 may analyze the received control signal 320A-320N using one or more algorithms, look up tables, and/or other information structures/techniques. The training module 304 may also store one or more characteristics of the control signal 320A-320N received from the original transmitter 212 in memory 204. Using the control signal(s) 320A-320N received from the original transmitter 212, the training module 304 may also train each of the one or more channels 310A-310N to control one or more functions of the remote device 112. The training module 304 may also initially store the one or more characteristics of the received control signal 320A-320N to one of the one or more channels 310A-310N.

The comparator module 306 may include instructions, programs, executable code, and/or other information used by the control circuit 202 to compare at least two control signals 320A-320N (or control information) stored by the training module 304 in memory 204. The comparator module 306 may access the memory 204 to retrieve the control signal(s) 320A-320N stored by the training module 304. In some embodiments, the comparator module 308 may receive control signals 320A-320N from the original transmitter 212 via the transceiver circuit 208. The comparator module 306 may detect or determine whether any two control signals 320A-320N received from the original transmitter 212 are similar or dissimilar based on any number of factors.

The training module 304 and the comparator module 306 may operate in conjunction to allow the trainable transceiver 102 to train multiple functions of the remote device 112 to a single channel 308A-308N of the trainable transceiver 102. In brief overview, the training module 304 may train one channel 308A-308N to control a first function of the remote device 112. In response to an attempt to train a second function of the remote device 112 at the same channel 308A-308N with a button press at the same command button 310A-310N, the comparator module 306 may determine whether the first function satisfies a message similarity condition with the second function of the remote device 112 (e.g., similar bit length, symbols, frequency, time duration, etc.). If the comparator module 306 determines that two functions satisfy the message similarity condition, the training module 304 may train the channel 308A-308N to control both the first function and the second function. Subsequently, successive presses of the command button 310A-310N corresponding to the trained channel 308A-308N may trigger the trainable transceiver 102 to alternatively send a first control signal to the remote device 112 for the first function and then a second control signal for the second function. The successive presses may also cause the trainable transceiver 102 to update a counter for keeping track of which control signal is to be sent. In this manner, the training module 304 and the comparator module 306 may allow for multiple functions of the remote device 112 with similar message characteristics to be trained onto a single channel 308A-308N. Training multiple functions to the same channel 308A-308N may allow a single command button 310A-310N to control multiple functions, thereby making space for more functions to be controlled and sent from the trainable transceiver 102.

In further detail, the training module 304 may train the corresponding channel 308A-308N to the one or more functions of the remote device 112. The training module 304 may use the control signal(s) 320A-320N from the original transmitter 212 to train the corresponding channel 308A-308N. The original transmitter 212 may transmit a control signal 320A-320N for controlling the one or more functions at the remote device 112. As discussed previously, the control signal 320A-320N may correspond to one of the one or more commands 316A-316N stored in memory 218 at the original transmitter 212. The command 316A-316N may correspond to a function at the remote device 112. The training module 304 may in turn receive the control signal 320A-320N from the original transmitter 212. In some embodiments, the training module 304 may store the control signal 320A-320N and the information thereof on the memory 204.

From the control signal 320A-N received from the original transmitter 212, the training module 304 may learn the control information to control the corresponding function on the remote device 112 using any number of techniques. In some embodiments, the training module 304 may access the memory 204 to retrieve the control signal 320A-320N stored thereon. The training module 304 may analyze or parse the control signal 320A-320N from the original transmitter 212. Based on the analysis or the parsing of the control signal 320A-320N, the training module 304 may store the control information in memory 204 in one of the channels 308A-308N. The one or more channels 308A-308N may be used by the control circuit 202 of the trainable transceiver 102 to control the corresponding function at the remote device 112. In some embodiments, the training module 304 may identify a code type (e.g., rolling code or fixed code) of the control signal 320A-320N based on message characteristics (e.g., bit sequence) of the control signal 320A-320N. If the training module 304 determines that the code type of the control signal 320A-320N is rolling code, the training module 304 may initiate and maintain a counter to keep track of the rolling code count. The training module 304 may cause the indicator 312 on the user interface 206 to indicate (e.g., using an audio and/or visual signal directed to the user) the outcome (e.g., success or failure) of the training of the channel 308A-308N. The training module 304 may repeat this functionality over multiple messages and/or signals over multiple channels 308A-308N.

In response to detecting a button press of a command button 310A-310N, the training module 304 may enter training mode to train the corresponding the channel 308A-308N or the trainable transceiver 102 may be caused to transmit control signals to control a function of the remote device 112. The training module 304 may determine whether to enter learning mode or to transmit control signals to the remote device 112 based on a time duration of the button press of the command button 310A-310N as described below. The training module 304 may identify the channel 308A-308N corresponding to the command button 310A-310N being pressed (e.g., the first channel 308A for the first command button 310A). The operations of the trainable transceiver 102 while in training mode will be discussed herein in conjunction with FIG. 3A. The operations of the trainable transceiver 102 while not in training mode will be discussed herein in conjunction with FIG. 3B.

While in training mode, the training module 304 may determine whether the channel 308A-308N has been previously trained to control any function of the remote device 112. In some embodiments, each channel 308A-308N may maintain a counter for the number of functions trained to be controlled by the channel 308A-308N. Each channel 308A-308N may update (e.g., increment or decrement) the counter, when a function is trained to be controlled by the channel 308A-308N or when the channel 308A-308N is cleared. The training module 304 may identify the number of functions trained from the counter. If the value of the counter is zero, the training module 304 may determine that the channel 308A-308N has not been trained to control any function of the remote device 112. If the value of the counter is greater than or equal to one, the training module 304 may determine that the channel 308A-308N has been trained to the number of functions indicated by the counter.

If the training module 304 determines that the channel 308A-308N has not been trained to control any function of the remote device 112, the training module 304 may train the channel 308A-308N using the control signal 320A-320N received from the original transmitter 212. As explained above, the training module 304 may use any number of techniques to learn the control information to control the corresponding function on the remote device 112 from the control signal 320A-320N. In some embodiments, the control signal 320A-320N may be received at the trainable transceiver 102 from the original transmitter 212, during the button press of the command button 310A-310N. In some embodiments, receipt of the control signal 320A-320N from the original transmitter 212 at the trainable transceiver 102 may be prior to the button press of the command button 310A-310N. The training module 304 may analyze or parse the control signal 320A-320N. Based on the analysis or the parsing of the control signal 320A-320N, the training module 304 may store the control information in memory 204 in one of the channels 308A-308N. The one or more channels 308A-308N may be used by the control circuit 202 of the trainable transceiver 102 to control the corresponding function at the remote device 112.

If the training module 304 determines that the channel 308A-308N has been trained to control at least one function of the remote device 112, the training module 304 may determine whether to enter learning mode to train the channel 308A-308N based on timing and/or durations of the press(es) of the command button 310A-310N. The training module 304 may identify a time of a previous button press on the command button 310A-310N and a time of the current button press on the command button 310A-N. The training module 304 may compare the time of the previous button press to the time of the current button press to determine whether to train the corresponding channel 308A-308N to be trained to control multiple functions of the remote device 112. In some embodiments, the training module 304 may determine whether a time elapsed between the previous button press and the current button press on the command button 310A-310N is less than or equal to a predefined time threshold. The predefined time threshold may correspond to an amount of time within which the user of the trainable transceiver 102 should press the command button 310A-310N again after training the corresponding channel 308A-308N to a previous function to train a new function, and may range from 0 to 120 seconds. The predefined time threshold may thus prevent accidental or unintentional training of the channel 308A-308N, thereby averting undesirable behavior on part of the trainable transceiver 102.

If the time elapsed between the two button presses is greater than the predefined time threshold, the training module 304 may maintain the information for controlling the previously trained functions and not enter training mode. Instead, the trainable transceiver 102 may send control signals to control one or more functions of the remote device 112, as will be described herein in conjunction with FIG. 3B. In some embodiments, if the time elapsed is greater than the predefined time, the training module 304 may clear the channel 308A-308N of the control information for controlling the function previously trained at the channel 308A-308N. The training module may also train the channel 308A-308N to control the new function.

On the other hand, if the time elapsed between the previous button press and the current button press is less than or equal to the predefined time threshold, the training module 304 may train the corresponding channel 308A-308N to control the new function, in accordance with the techniques detailed herein. In some embodiments, in either condition, the training module 304 may cause an electronic display (e.g., center stack 106) coupled to the trainable transceiver 102 to display a prompt for adding the new function or deleting the functions previously trained at the channel 308A-308N. Upon receiving a response indicating addition of the new function, the training module 304 may train the channel 308A-308N to control the new function of the remote device 122. Upon receiving a response indicating deletion of previously trained functions, the training module 304 may clear information regarding the previously trained function from the channel 308A-308N.

In some embodiments, to determine whether to enter training mode, the training module 304 may identify a time duration of the button press on the corresponding command button 310A-310N. In some embodiments, a single button press on the command button 310A-310N may be used to train the corresponding channel 308A-308N to multiple functions of the remote device 112. The training module 304 may compare the time duration to a predetermined time threshold. The predetermined time threshold may correspond to an amount of time that the user of the trainable transceiver 102 should press and hold the command button 310A-310N to enter the training mode for the channel 308A-308N, and may range from 0 to 15 seconds. The predefined time threshold may thus prevent accidental or unintentional training of the channel 308A-308N, thereby averting undesirable behavior on part of the trainable transceiver 102. If the time duration of the button press is less than or equal to the predefined time threshold, the training module 304 may limit the channel 308A-308N to functions already trained at the channel 308A-308N. On the other hand, if the time duration of the button is greater than the predefined time threshold, the training module 304 may train the corresponding channel 308A-308N to control multiple functions of the remote device 112, in accordance with the techniques detailed herein.

In some embodiments, to enter training mode, the training module 304 may identify both the time elapsed between the previous button press and the current button press and the time duration of the current button press on the corresponding command button 310A-310N. The training module 304 may determine that the channel 308A-308N has been trained to control at least one function of the remote device 112. If the time duration of the current button press is greater than or equal to a first predetermined time threshold, the training module 304 may then identify the time elapsed between the previous button press and the current button press. The first predetermined time threshold may be greater than the predetermined time threshold used to trigger the trainable transceiver 102 to enter the training mode, when the channel 308A-308N does not have a previously trained function. In some implementations, the first predetermined time threshold may range between 0 to 25 seconds. If the time duration of the current button press is less than the first predetermined threshold, the pressing of the command button 310A-310N may cause the trainable transceiver 102 to send control signals, as will be described herein below in conjunction with FIG. 3B. If the time elapsed between the previous button press and the current button press is below a second predetermined time threshold, the training module 304 may enter training mode for the channel 308A-308N corresponding to the command button 310A-310N as described herein. The second predetermined time threshold may range from 0 to 120 seconds. If the time elapsed is greater than or equal to the second predetermined time threshold, the training module 304 may limit the channel 308A-308N to functions already trained at the channel 308A-308N corresponding to the command button 310A-310N. In addition, the pressing of the command button 310A-310N may cause the trainable transceiver 102 to send control signals, as will be described herein below in conjunction with FIG. 3B. In some implementations, the training module 304 may first identify the time elapsed between the previous button press and the current button press, and then may similarly determine whether the time duration of the current button press is greater than the first predetermined time threshold in reverse order.

In some embodiments, the training module 304 may identify a number of functions trained to be controlled by the channel 308A-308N, responsive to determining that the channel 308A-308N has been trained to control at least one function. In some embodiments, each channel 308A-308N may maintain the counter for the number of functions trained to be controlled by the channel 308A-308N. Each channel 308A-308N may update (e.g., increment or decrement) the counter, when a new function is trained to be controlled by the channel 308A-308N or when the channel 308A-308N is cleared. The training module 304 may compare the number of functions trained to a predetermined threshold number of functions. The predetermined threshold number of functions may correspond to the maximum number of functions permitted to be trained at the channel 308A-308N. The predetermined number of functions may range from two to four functions (e.g., unlock, lock, open, or close a door controlled by the remote device 112).

If the number of functions trained to be controlled by the channel 308A-308N is greater than or equal to the maximum number of functions, the training module 304 may restrict training of the channel 308A-308N to additional functions of the remote device 112. In some embodiments, the training module 304 may clear the channel 308A-308N to delete information for previously trained functions. In some embodiments, the training module 304 may cause an electronic display (e.g., center stack 106) coupled to the trainable transceiver 102 to display a prompt for selecting which previously trained functions to delete and/or replace from the channel 308A-308N. In response to an indication of a selection, the training module 304 may clear information regarding the selected function from the channel 308A-308N. The training module 304 may then proceed to train the channel 308A-308N to the new function, using the techniques detailed herein. On the other hand, if the number of functions trained to be controlled by the channel 308A-308N is less than the predetermined number of functions, the training module 304 may train the corresponding channel 308A-308N to control multiple functions of the remote device 112, in accordance with the techniques detailed herein.

If more than one function is to be trained onto a single channel 308A-308N, the training module 304 may determine whether a function to be trained satisfy a message similarity condition with the function(s) previously trained. The message similarity condition may specify one or more specifications regarding the control signals 320A-320N (e.g., a first control signal 320A and a second control signal 320B, etc.) for each function to be trained onto the channel 308A-308N. In some embodiments, the message similarity condition may specify that the first control signal 320A may not be identical to the second control signal 320B. In some embodiments, the message similarity condition may specify that the first control signal 320A and the second control signal 320B are of the same encoding (e.g., fixed code or rolling code). In some embodiments, the message similarity condition may specify that the first control signal 320A and the second control signal 320B differ in symbol sequence (e.g., binary code) by less than a predetermined number. In some embodiments, the message similarity condition may specify that the first control signal 320A and the second control signal 320B have a same subset of symbols in the symbol sequence for each. In some embodiments, the message similarity condition may specify that the first control signal 320A and the second control signal 320B are of the same length in time duration or number of symbols (e.g., bits). In some embodiments, the message similarity condition may specify that the first control signal 320A and the second control signal 320B are of the same frequency.

Upon satisfying one or more specifications of the message similarity condition, the training module 304 may continue to train the channel 308A-308N to control the function of the remote device 112, responsive to satisfying one or more specifications of the message similarity condition. In some embodiments, the training module 304 may traverse through each of the previously stored function(s) in the respective channel 308A-308N to determine whether the new function satisfies the message similarity condition with each of the previously stored functions. To compare two or more control signals 320A-320N for the functions to be trained on the channel 308A-308N, the training module 304 may relay information regarding the received control signals 320A-320N to the comparator module 306.

To determine whether any two control signals 320A and 320B of any two functions satisfy the message similarity condition, the comparator module 306 may compare message characteristics. The message characteristics may include encoding type (e.g., fixed code or rolling code), frequency, symbols, time duration, and number of pulses, among others. The comparator module 306 may generate or derive the message characteristics of the control signals 320A-320N from the analysis of the control signals 320A-320N by the training module 304. In some embodiments, the comparator module 306 may identify a first message characteristic for the first control signal 320A. The comparator module 306 may identify a second message characteristic for the second control signal 320B. The comparator module 306 may compare the first message characteristic for the first control signal 320A with the second message characteristic for the second control signal 320B. In some embodiments, the comparator module 306 may determine that the first message characteristic is similar to the second message characteristic in accordance with the message similarity condition. Based on the comparison of the first and second message characteristics, the comparator module 306 may determine whether the first function and the second function satisfy the message similarity condition.

In some embodiments, the comparator module 306 may compare the frequencies of any two control signals 320A and 320B to determine whether the respective functions satisfy the message similarity condition. The trainable transceiver 102, the original transmitter 212, and the remote device 112 may be set or configured to transmit and receive signals or otherwise operate at a pre-specified ranges of frequencies (e.g., from 285 to 440 MHz when set to operate in North America or from 314 to 316 MHz or from 433 to 435 MHz when set to operate in China). The trainable transceiver 102 may be set to one of the pre-specified ranges of frequencies. In some embodiments, the trainable transceiver 102 may be set to operate from 314 to 316 MHz range or from 433 to 435 MHz range when configured to operate in China (e.g., by setting the country code to 9). In some embodiments, the trainable transceiver 102 may bet set to operate from 285 to 440 MHz when configured to operate in North America. To account for such settings, the comparator module 306 may determine the frequencies of each control function 320A-320N by identifying the frequency corresponding to the maximum amplitude in the frequency domain of the respective control signal 320A-320N. The comparator module 306 may compare the frequency of the first control signal 320A and the frequency of the second control signal 320B. In some embodiments, the comparator module 306 may calculate a frequency difference between the frequency of the first control signal 320A and the frequency of the second control signal 320B. The comparator module 306 may compare the frequency difference with a predetermined tolerance margin (e.g., 0 to 3% difference in frequency). If the frequency difference is less than or equal to the predetermined tolerance margin, the comparator module 306 may determine that the first function corresponding to the first control signal 320A and the second function corresponding to the second control signal 320B satisfy the message similarity condition. If the frequency difference is greater than the predetermined tolerance margin, the comparator module 306 may determine that the first function and the second function do not satisfy the message similarity condition.

In some embodiments, the comparator module 306 may compare the number of pulses of any two control signals 320A and 320B in determining whether the respective functions satisfy the message similarity condition. The comparator module 306 may determine the number of pulses for each control signal 320A-320N by counting a number of times when a magnitude of the control signal 320A-320N increases above a predetermined threshold. The comparator module 306 may compare the number of pulses of the first control signal 320A and the number of pulses of the second control signal 320B. In some embodiments, the comparator module 306 may calculate a pulse number difference between the number of pulses of the first control signal 320A and the number of pulses of the second control signal 320B. The comparator module 306 may compare the pulse number difference with a predetermined maximum number (e.g., 0 to 10 pulses). If the pulse number difference is less than or equal to the predetermined maximum number, the comparator module 306 may determine that the first function corresponding to the first control signal 320A and the second function corresponding to the second control signal 320B satisfy the message similarity condition. If the pulse number difference is greater than the predetermined maximum number, the comparator module 306 may determine that the first function and the second function do not satisfy the message similarity condition. In some embodiments, if the number of pulses of the first control signal 320A equals the number of pulses of the second control signal 320B, the comparator module 306 may determine that the first function and the second function satisfy the message similarity condition. If the number of pulses of the first control signal 320A does not equal the number of pulses of the second control signal 320B, the comparator module 306 may determine that the first function and the second function do not satisfy the message similarity condition.

In some embodiments, the comparator module 306 may compare the time duration of any two control signals 320A and 320B to determine whether the respective functions satisfy the message similarity condition. The comparator module 306 may determine the time duration for each control signal 320A-320N by keeping track of the time an amplitude of the control signal 320A-320N increases above a threshold and then decreases below the threshold. In keeping track of the time, the comparator module 306 may maintain a counter on the memory 204 of the control circuit 202. The comparator module 306 may compare the time duration of the first control signal 320A and the time duration of the second control signal 320B. In some embodiments, the comparator module 306 may calculate a time duration difference between the time duration of the first control signal 320A and the time duration of the second control signal 320B. The comparator module 306 may compare the time duration difference with a predetermined tolerance margin (e.g., 0 to 7% difference in time). If the time duration difference is less than or equal to the predetermined threshold margin, the comparator module 306 may determine that the first function corresponding to the first control signal 320A and the second function corresponding to the second control signal 320B satisfy the message similarity condition. If the time duration difference is greater than the predetermined tolerance margin, the comparator module 306 may determine that the first function and the second function do not satisfy the message similarity condition.

In some embodiments, to determine whether any two functions satisfy the message similarity condition, the comparator module 306 may compare the symbol sequences (e.g., binary code) of the two respective control signals 320A and 320B. The comparator module 306 may identify a symbol sequence for each control signal 320A-320N based on an analog-to-digital conversion of the control signal 320A-320N received from the original transmitter 212. The comparator module 306 may compare the symbol sequence of the first control signal 320A and the symbol sequence of the second control signal 320B. In some embodiments, the comparator module 306 may calculate a number of different symbols between the symbol sequence of the first control signal 320A and the symbol sequence of the second control signal 320B. The comparator module 306 may compare the number of different symbols with a predetermined threshold number (e.g., 0 to 8 bits). If the number of different symbols is less than or equal to the predetermined threshold number, the comparator module 306 may determine that the first function corresponding to the first control signal 320A and the second function corresponding to the second control signal 320B satisfy the message similarity condition. If the number of different symbols is greater than the predetermined threshold number, the comparator module 306 may determine that the first function and the second function do not satisfy the message similarity condition.

In some embodiments, the comparator module 306 may identify a subset of the symbol sequence for each control signal 320A-320N (e.g., first 3 to 5 bits). The comparator module 306 may determine whether the subset of the symbol sequence for the first control signal 320A is the same as the subset of the symbol sequence for the first control signal 320B. If the two subsets of the symbols sequences are the same, the comparator module 306 may determine that the first function and the second function satisfy the message similarity condition. If the two subsets of the symbols sequences differ, the comparator module 306 may determine that the first function and the second function do not satisfy the message similarity condition.

In some embodiments, the comparator module 306 may compare the code type (e.g., rolling code or fixed code) of any two control signals 320A and 320B to determine whether the respective two functions satisfy the message similarity condition. The comparator module 306 may identify a code type for each control signal 320A-320N by analyzing the symbol sequence of the control signals 320A-320N received from the original transmitter 212. The comparator module 306 may compare the code type of the first control signal 320A with the code type of the second control signal 320B. If the code type of the first control signal 320A matches the code type of the second control signal 320B, the comparator module 306 may determine that the first function corresponding to the first control signal 320A and the second function corresponding to the second control signal 320B satisfy the message similarity condition. If the code type of the first control signal 320A does not match the code type of the second control signal 320B, the comparator module 306 may determine that the first function and the second function do not satisfy the similarity condition.

If the comparator module 306 determines that the two or more functions do not satisfy the message similarity condition, the training module 304 may cause the indicator 312 on the user interface 206 to indicate (e.g., using an audio and/or visual signal directed to the user) a failed training of the channel 308A-308N. In some embodiments, the training module 304 may halt training of the channel 308A-308N and may maintain the channel 308A-308N to control the previously trained functions. In some embodiments, the training module 304 may overwrite the channel 308A-308N to clear information regarding previously trained functions and may train the channel 308A-308N to the new function. In some embodiments, the training module 304 may attempt to retrain the channel 308A-308N to the new function, repeating the operations described above. The training module 304 may maintain a counter for a number of times for retraining the channel 308A-308N. The training module 304 may compare the number of times for retraining to a maximum threshold number. If the number of times is greater than or equal to maximum threshold number, the training module 304 may terminate retraining and may indicate via the indicator 312 failure of training the channel 308A-308N. If the number of times is less than the maximum threshold number, the training module 304 may increment the counter and may retrain the channel 308A-308N to control the new function.

In some embodiments, in response to not satisfying the message similarity condition, training module 304 may cause an electronic display (e.g., center stack 106) coupled to the trainable transceiver 102 to display a prompt for adding the new function or deleting the functions previously trained at the channel 308A-308N. Upon receiving a response indicating addition of the new function, the training module 304 may train the channel 308A-308N to control the new function of the remote device 122. Upon receiving a response indicating deletion of previously trained functions, the training module 304 may clear information regarding the previously trained function from the channel 308A-308N. In some embodiments, the training module 304 may train the channel 308A-308N to control both the new and previously stored function, regardless of the new function and the previously stored functions not satisfying the message similarity condition.

In contrast, if the comparator module 306 determines that the two or more functions satisfy the message similarity condition, the training module 304 may train the channel 308A-308N to control the functions. The training module 304 may analyze or parse the control signal 320A-320N for the new functions from the original transmitter 212. Based on the analysis or the parsing of the control signal 320A-320N, the training module 304 may store the control information in memory 204 in the same channel 308A-308N as the previously stored function. In some embodiments, responsive to the determination that the first function and the second function satisfy the message similarity condition, the training module 304 may train, set, or configure the channel 308A-308N to control both the first function and the second function of the remote device 112. In some embodiments, training module 304 may cause the indicator 312 on the user interface 206 to indicate (e.g., using an audio and/or visual signal directed to the user) a successful training of the channel 308A-308N. In some embodiments, the training module 304 may maintain a rolling code counter for both the one or more functions trained at the channel 308A-308N, responsive to determining that the code type of the functions is rolling code. In some embodiments, the training module 304 may maintain separate rolling code counters for each of the one or more functions trained at the channel 308A-308N, responsive to the determination. By training multiple functions with similar message characteristics to the same channel 308A-308N, more command buttons 310A-310N may be freed up for other uses on the trainable transceiver 102.

This configuration may increase the number of functions of the remote device 122 that may be controllable by the trainable transceiver 102, thereby improving human-computer interactions and computer memory management.

Figure 3B:
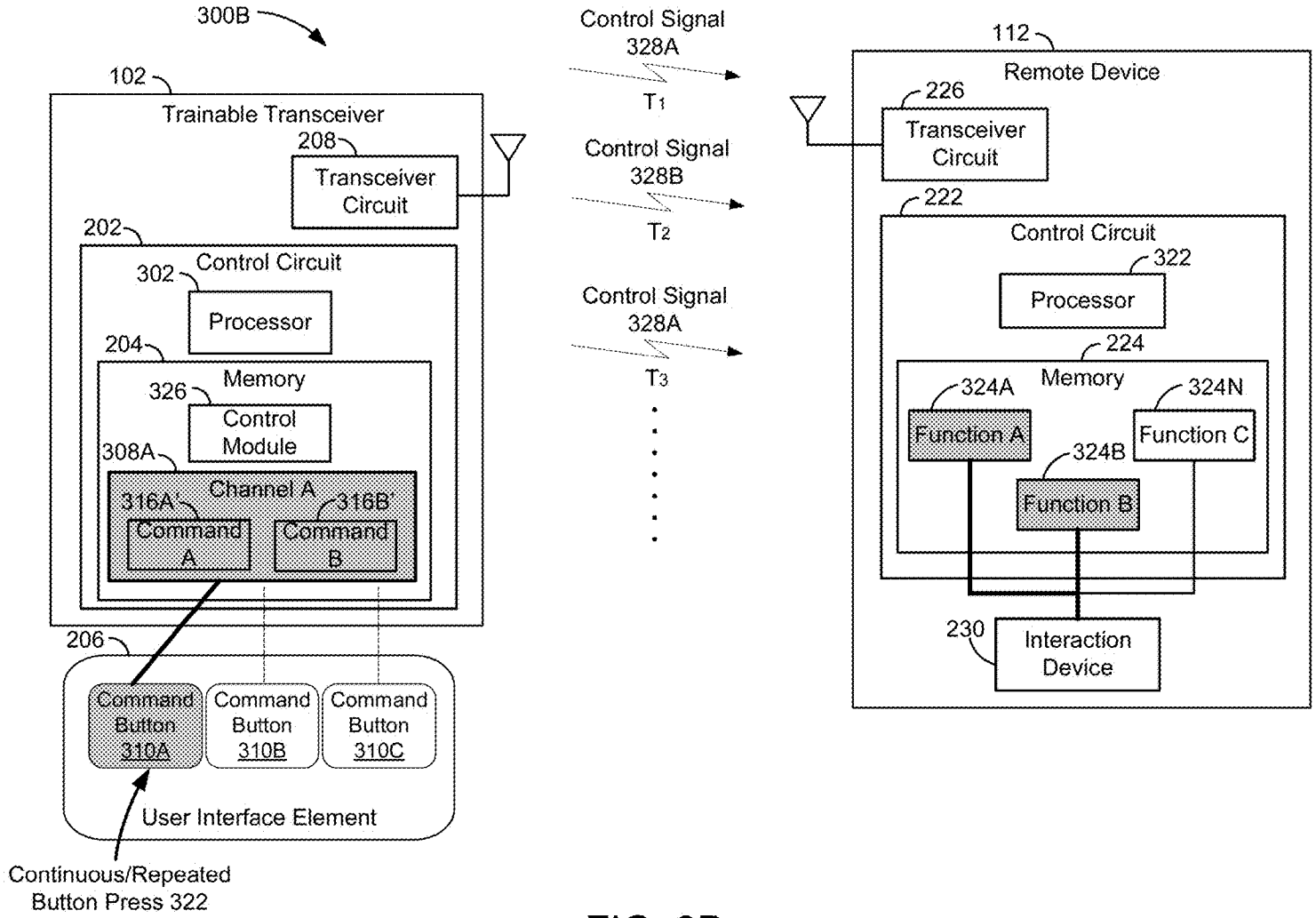
FIG. 3B is a block diagram of a system for controlling multiple functions with a single transceiver channel, according to an illustrative embodiment.

Referring now to FIG. 3B, a block diagram of the trainable transceiver 102 in communication with the remote device 112 to control one or more functions thereof is shown, in accordance with an illustrative embodiment. The trainable transceiver 102 and the remote device 112 may include the components and features illustrated and described above with reference to FIGS. 2 and 3A. Additionally, in the scheme described in system 300B, the control circuit 222 of the remote device 112 may include a processor 322 and one or more functions 324A-324N for controlling the interaction device 230. Moreover, at this point, the training of the channel 308A-308N (e.g., first channel 308A) at the trainable transceiver 102 using control signals 320A-320N from the original transmitter 212 may have been completed. The first channel 308A may have been trained to control two functions, the first function 324A and the second function 324B, of the remote device 112 and may have stored two commands 316A' and 316B' from the training. Each of the commands 316A'-316N' may correspond to one of the control signals 328A-328N sent by the trainable transceiver 102 to control the remote device 112. Each control signal 328A-328N in turn may correspond to one of the functions 324A-324N of the remote device 112 for controlling the interaction device 230. The memory 204 of the trainable transceiver 102 may also include a control module 326.

The control module 326 may include instructions, programs, executable code, and/or other information used by the control circuit 202 to perform training functions. Responsive to a pressing 322 of a command button 310A-310N, the control module 326 may identify the channel 308A-308N corresponding to the command button 310A-310N. The control module 326 may select a command 316A'-316'N stored at the identified channel 308A-308N. The control module 326 may then cause the trainable transceiver 102 to send the control signal 328A-328N to the remote device 112 to control the one or more functions 324A-324N based on the pressing 328 of the command button 310A-310N.

Once the channel 308A-308N is trained to control multiple functions of the remote device 112, a pressing 328 of the corresponding command button 310A-310N may cause the channel 308A-308N to alternately control the multiple trained functions. The pressing 328 on the command button 310A-310N may be continuous (e.g., press and hold) and/or successive. In some embodiments, the control circuit 202 may compare a time duration of the pressing 328 of command button 310A-310N to a predetermined time threshold. The predetermined time threshold may be used to demarcate when to trigger the training module 304 to enter training mode or when to trigger the control module 326 to manage sending of control signals 328A-328N to control one or more functions of the remote device 112. If the time duration of the pressing 328 of the command button 310A-310N is more than the predetermined time threshold, the trainable transceiver 102 may enter training mode for training the channel 308A-308N corresponding to the command button 310A-310N, and may execute the functionalities of the training module 304 and the comparator module 306 as described above. On the other hand, if the time duration is less than the predetermined time threshold, the control module 326 may cause the trainable transceiver 102 to send one or more the control signals 328A-328N to control the one or more functions 324A-324N of the remote device 112.

While the time duration of the continuous button press 322 is less than the predetermined time threshold, the control module 326 may alternately select the commands 316A'-316N' stored on the channel 308A-308N based on the time duration. Responsive to the button press 322, the control module 326 (or the control circuit 202) may identify the channel 308A-308N corresponding to the command button 310A-310N. The control module 326 may maintain a timer on the memory 204 to keep track of the time duration of the button press 322. The control module 326 may also maintain a schedule for selecting one of the commands 316A'-316N' (e.g., selecting the first command 316A' for the first 5 seconds and selecting the second command 316B" for the next 6 seconds, and then repeat). The schedule may specify a plurality of time intervals within which to select one of the commands 316A'-316N'. The control module 326 may select one of the commands 316A'-316N' in accordance with the schedule. The control module 326 may in turn cause the trainable transceiver 102 to transmit the control signal 328A-328N corresponding to the selected command 316A'-316N'.

In some embodiments, upon successive button presses 322, the control module 326 may alternately select the commands 316A'-316N' stored on the channel 308A-308N. In some embodiments, the successive button presses 322 each may be less than the predetermined time threshold for entering training mode. Responsive to the button press 322, the control module 326 (or the control circuit 202) may identify the channel 308A-308N corresponding to the command button 310A-310N. In some embodiments, the control module 326 may maintain a counter on memory 204 to keep track of a number of button presses for each command button 310A-310N. In some embodiments, the control module 326 may maintain an identifier (or some non-volatile variable) on the channel 308A-308N in memory 204 to reference the command 316A'-316N' to be selected. Based on the value in the counter or the reference identifier, the control module 326 may select the command 316A'-316N' of the channel 308A-308N corresponding to the command button 310A-310N (e.g., a first button press may result in selecting of the first command 316A' and a second button press may result in selecting the second command 316B', and so forth). The control module 326 may then cause the trainable transceiver 102 to transmit the control signal 328A-328N corresponding to the selected command 316A'-316N'. Responsive to the button press 322, the control module 326 may update or increment the counter for the command button 310A-310N or the reference identifier in the channel 308A-308N, such that the next button press 322 may result in the next command 316A'-316N' being selected.

By configuring the selection of commands 316A'-316N' in this manner, the trainable transceiver 102 may send control signals 328A-328N to alternately activate various functions 324A-324N of the remote device 112. If a command other than the one intended by the user is sent to the remote device 112, the user of the trainable transceiver 102 may see that nothing is occurring at the remote device 112. The user in turn may instinctively press the command button 308A-308N again to send another control signal 328A-328N to actuate the desired function 324A-324N at the remote device 112.

Figure 4B:
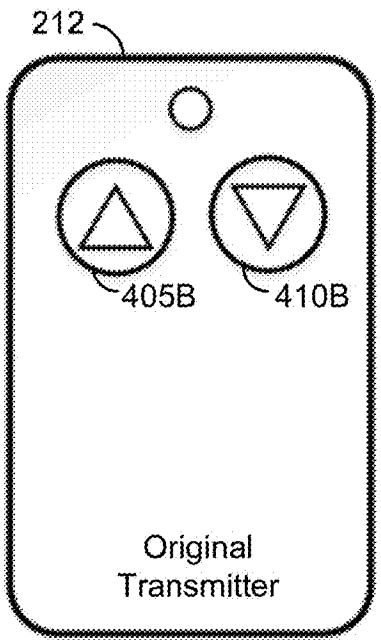
FIGS. 4A and 4B are block diagrams of various configurations of the original transmitter, according to illustrative embodiments.
Figure 4A:
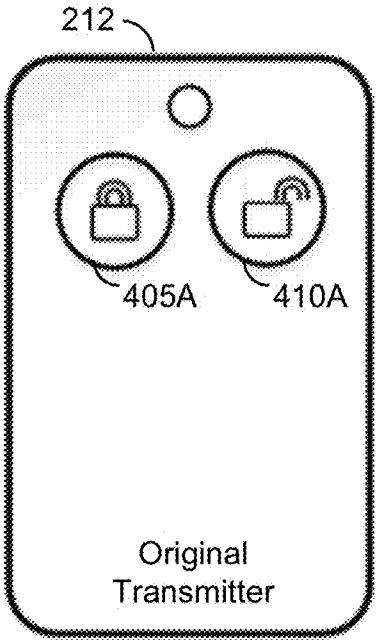

Referring now to FIGS. 4A and 4B, various configurations 400A and 400B of the command buttons on the original transmitter are shown, according to illustrative embodiments. Both configurations 400A and 400B may be the human-machine interface of the original transmitter 212 with two command buttons each. The two command buttons may cause the original transmitter 212 to send a control signal 320A-320N to actuate a function at the remote device 112.

In configuration 400A, the original transmitter 212 may have a lock command button 405A and an unlock command button 410A. The lock command button 405A may cause the original transmitter 212 to transmit a control signal 320A to the remote device 112 to unlock a barrier (e.g., a garage door). The unlock command button 410A may cause the original transmitter 212 to transmit another control signal 320B to the remote device 112 to lock a barrier. The control signal 320A for unlocking the barrier and the control signal 320B for locking the barrier may satisfy the message similarity condition (e.g., similar bit length, symbols, frequency, time duration, etc.) as described above in conjunction with system 300A.

In configuration 400B, the original transmitter 212 may have a door up command button 405B and a door down command button 410B. The door up command button 405A may cause the original transmitter 212 to transmit a control signal 320C to the remote device 112 to raise a barrier (e.g., a parking barrier). The door down command button 410B may cause the original transmitter 212 to transmit another control signal 320C to the remote device 112 to lower the barrier. The control signal 320C for raising the barrier and the control signal 320D for lowering the barrier may satisfy the message similarity condition (e.g., similar bit length, symbols, frequency, time duration, etc.) as described above in conjunction with system 300A.

Figure 5:
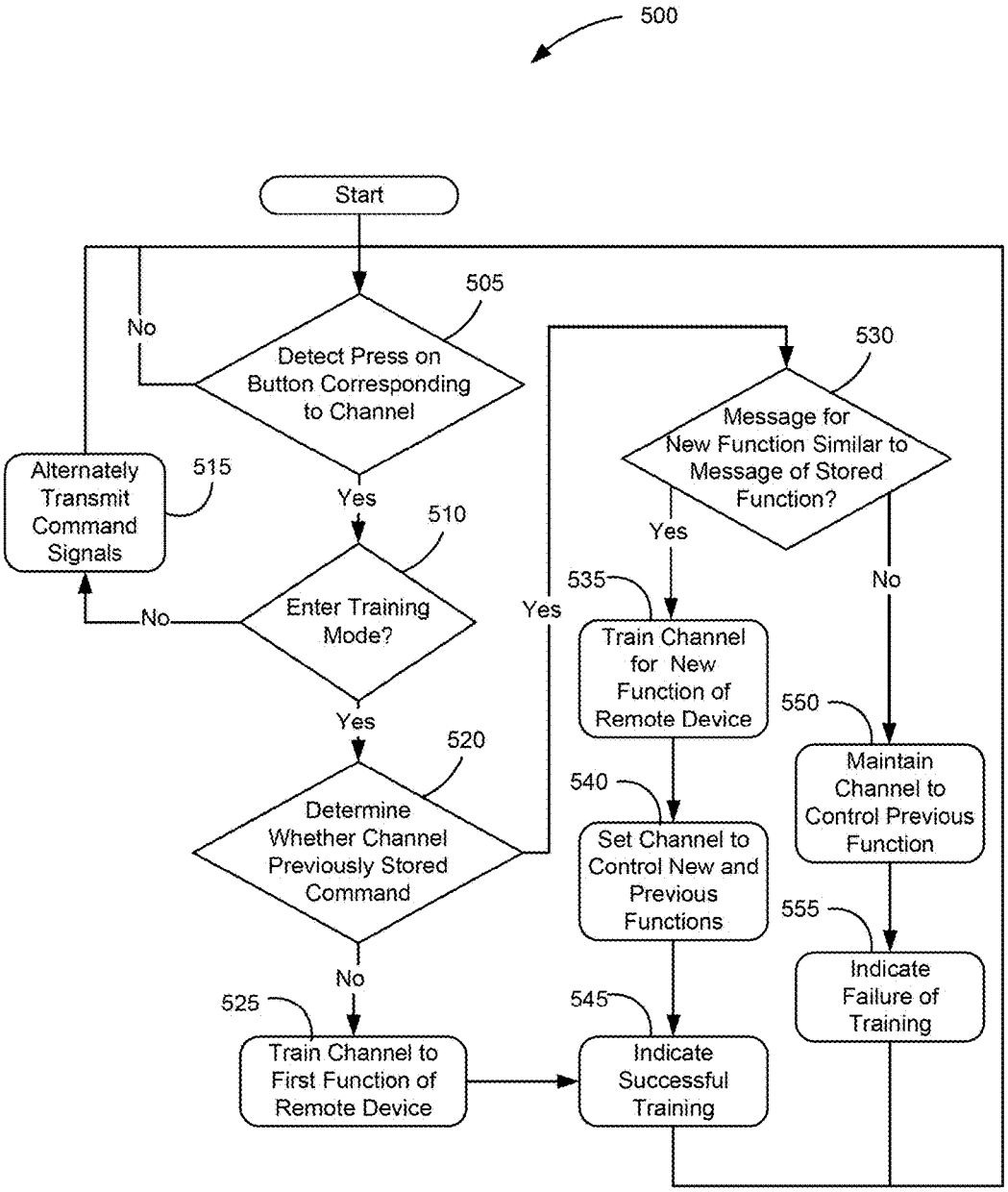
FIG. 5 is a flow diagram of a method of controlling and training multiple functions with a single transceiver channel, according to illustrative embodiments.

Referring now to FIG. 5, a method 500 of controlling and training multiple functions with a single transceiver channel is shown, according to an illustrative embodiment. The method 500 may be performed using various components and/or modules detailed herein, such as the trainable transceiver 102 as described in conjunction with FIGS. 2 and 3.

At step 505, the trainable transceiver may detect whether a press on a command button corresponding to a channel has occurred. Each command button on the trainable transceiver may correspond to a single channel. Each channel may be trained to control one or more functions at the remote device. In some embodiments, the trainable transceiver may identify the channel corresponding to the command button. If no button press is detected, the functionality of step 505 may be repeated by the trainable transceiver until the detection of such a button press.

If the button press is detected, at step 510, the trainable transceiver may determine whether to enter training mode. In some embodiments, the trainable transceiver may determine whether to enter training mode based on a time duration of the button press and/or time elapsed between two button presses. The trainable transceiver may compare the time duration of the button press to a predetermined time threshold. If the time duration is greater than or equal to the predetermined time threshold, the trainable transceiver may enter training mode. If the time duration is less than to the predetermined time threshold, the trainable transceiver may determine not to enter training mode. In some embodiments, the trainable transceiver may also identify a time elapsed between a previous button press and a current button press. The trainable transceiver may compare the time elapsed to a predetermined time window. If the time elapsed is less than the predetermined time window, the trainable transceiver may enter training mode. If the time elapsed is greater than the predetermined time window, the trainable transceiver may determine not to enter training mode. In some embodiments, the trainable transceiver may enter training mode, upon determining that the time duration of the current button press is greater than the predetermined time threshold and that the time elapsed between the previous and the current button presses are within the predetermined window. In some embodiments, the predetermined time threshold for the time duration of the current button press to enter training mode may be longer than the predetermined time threshold for the time duration of the previous button press.

If the trainable transceiver does not enter training mode, at step 515, the trainable transceiver may alternately transmit command signal to a remote device. In some embodiments, while the command button corresponding to the command button is being pressed, the trainable transceiver may alternately select commands previously trained on the channel. The trainable transceiver may then transmit a control signal corresponding to the selected command to the remote device to control a corresponding function thereon. The trainable transceiver may then repeat the functionality of step 505.

If the trainable transceiver enters training mode, at step 520, the trainable transceiver may determine whether the channel has a previously stored command. In some embodiments, trainable transceiver may maintain a counter to keep track of a number of functions trained at the channel. If the counter is zero, the trainable transceiver may determine that the channel does not have a previously stored command. If the counter is greater than or equal to one, the trainable transceiver may determine that the channel has a previously stored command.

If there are no previously stored commands on the channel, at step 525, the trainable transceiver may train the channel to a first function of the remote device. In some embodiments, the trainable transceiver may access the memory to retrieve the control signal sampled and stored thereon or may receive the control signal directly from the original transmitter while in training mode. The trainable transceiver may analyze or parse the control signal from the original transmitter. Based on the analysis or the parsing of the control signal, the trainable transceiver may store the control information in memory in one of the channels.

If there are previously stored commands on the channel, at step 530, the trainable transceiver may determine whether the message for the new function is similar to the message of the stored function. The message similarity condition may specify one or more specifications regarding the control signals for each function to be trained onto the channel. The message similarity condition may specify that: a control signal for the previously stored function and a control signal for the new function may not be identical; the control signal for the previously stored function and the control signal for the new function are to be of the same encoding (e.g., fixed or rolling code); the two control signals are to differ in symbol sequence (e.g., binary code) by less than a predetermined number; the two control signals are to be of the same length in time; the two control signals are to be of the same frequency; and/or the two control signals are to have the same number of symbols (e.g., bits). The trainable transceiver may determine that the message for the new function is similar to the message of the previously stored function, if any one or more of the specifications of the message similarity condition are satisfied. In contrast, the trainable transceiver may determine that the message for the new function is dissimilar to the message of the previously stored function, if any none of the specifications of the message similarity condition are satisfied.

If the message for the new function is similar to the message of the stored function, at step 535, the trainable transceiver may train the channel for the new function of the remote device. The trainable transceiver may analyze or parse the control signal for the new function from the original transmitter. Based on the analysis or the parsing of the control signal, the trainable transceiver may store the control information in memory in one of the channels. At step 540, the trainable transceiver may set the channel to control both the previously stored function and the newly trained function. In some embodiments, the trainable transceiver may store the control information for the new function at the same channel as the previously stored function. At step 545, the trainable transceiver may indicate successful training. In some embodiments, the trainable transceiver may cause an LED to blink to indicate successful training. The trainable transceiver may the repeat the functionality of step 505.

On the other hand, if the message for the new function is not similar to the message of the stored function, at step 550, the trainable transceiver may maintain the channel to control the previously stored function. In some embodiments, the trainable transceiver may delete the channel of the previously stored function and train the channel to the new function. At step 555, the trainable transceiver may indicate failure of training. In some embodiments, the trainable transceiver may cause an electronic display to display a prompt for maintaining the previously stored functions or adding the new function. In response to a response indicating maintaining the previously stored function, the trainable transceiver may maintain the channel to control the previously stored function and not train the channel to the new function. In response to a response indicating addition of the new function, the trainable transceiver may clear the channel to delete the previously stored function and train the channel to the new function. The trainable transceiver may then repeat the functionality of step 505.

Figure 6:
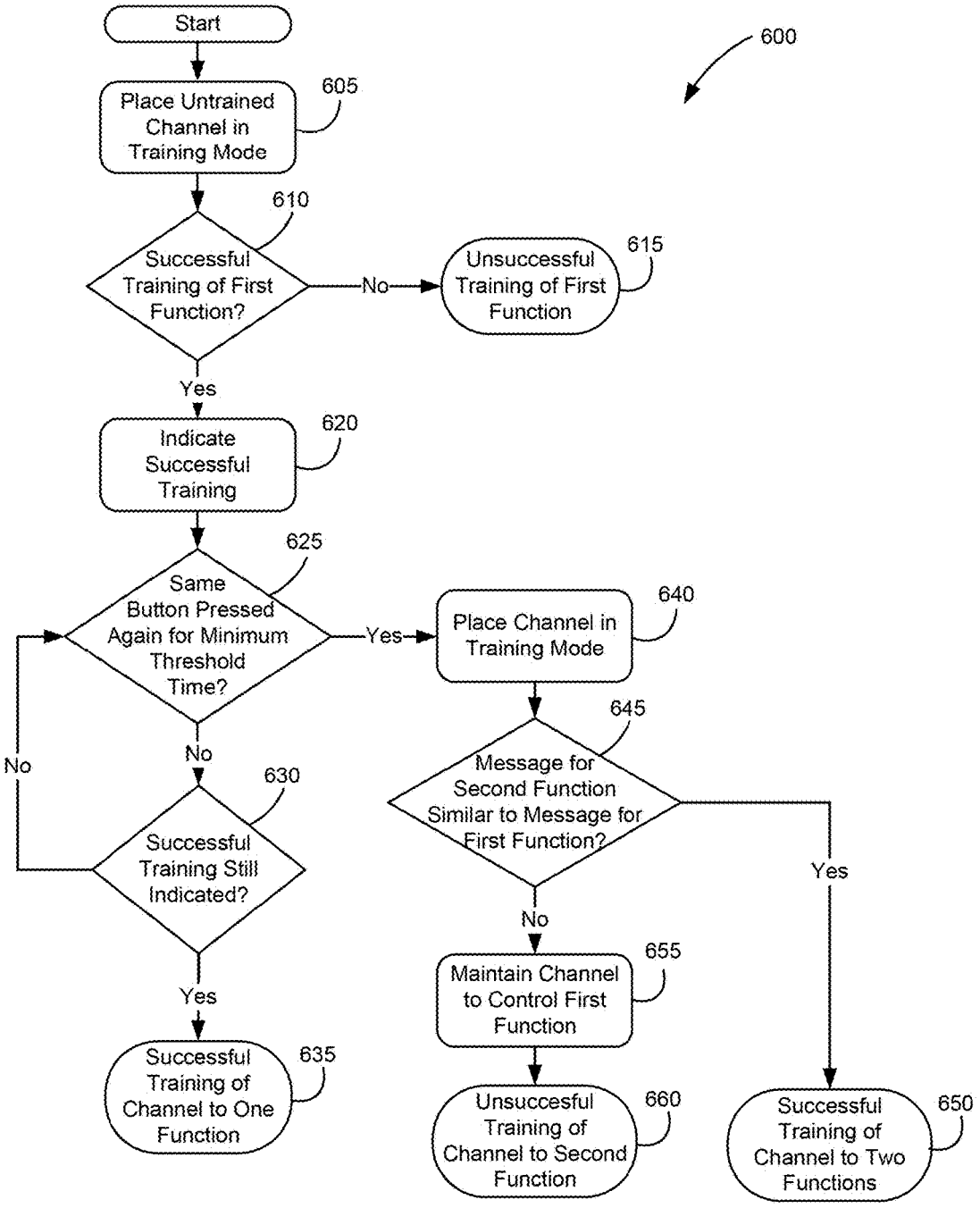
FIG. 6 is a flow diagram of a method of training multiple functions to a single channel of trainable transceivers, according to illustrative embodiments.

Referring now to FIG. 6, a method 600 of training multiple functions with a single transceiver channel is shown, according to an illustrative embodiment. The method 600 may be performed using various components and/or modules detailed herein, such as the trainable transceiver 102 as described in conjunction with FIGS. 2 and 3. Methods 500 and 600 may be performed by the same embodiments of the trainable transceiver 102.

At step 605, the trainable transceiver may place an untrained channel in training mode. Each channel may correspond to a button on the trainable transceiver. The channel may be placed in training mode upon the button being pressed for a minimum time threshold. The trainable transceiver may analyze or parse the control signal for actuating a function of a remote device from an original transmitter. Based on the analysis or the parsing of the control signal, the trainable transceiver may store the control information in memory in one of the channels. In some embodiments, the trainable transceiver may determine that the channel is untrained based on a value of a counter for keeping track of the number of functions trained being null.

At step 610, the trainable transceiver may determine whether the training of the channel to the first function was successful. The trainable transceiver may identify the control information (e.g., frequency, symbol sequence, etc.) for the first function stored at the channel from training mode. To determine whether the training was successful, the trainable transceiver may verify whether the control information is complete. If the control information is not complete, the trainable transceiver may determine that the training was not successful. If the training was not successful, at step 615, the method 600 may be terminated with an unsuccessful training of the channel to the first function. In some embodiments, the trainable transceiver may additionally indicate unsuccessful training (e.g., with an LED indicator on a human-machine interface at the trainable transceiver). On the other hand, if the control information is complete, the trainable transceiver may determine that the training was successful. If the training was successful, at step 620, the trainable transceiver may indicate successful training (e.g., with the LED indicator on the human-machine interface).

Upon detecting another button press on the same button, at step 625, the trainable transceiver may determine whether the same button is pressed again for a minimum threshold time. The minimum threshold time may correspond to the duration of time that a user of the trainable transceiver has to hold the button to trigger training mode again to train the same channel to a second function. In some embodiments, the minimum threshold time to trigger training mode again at the same channel may be greater the minimum threshold time to trigger the training mode when the channel was untrained.

If the same button is not pressed for the minimum threshold time, at step 630, the trainable transceiver may determine whether the channel still indicates successful training of the first function. The user of the trainable transceiver may have caused the channel to be cleared of any prior training. The trainable transceiver may again verify whether the control information is complete. If the control information is not complete, the functionality of step 625 may be repeated. In contrast, if the control information is complete, the trainable transceiver may determine that the training was successful. If the training was successful, the method 600 may terminate at step 635 with the successful training of the channel to the first function.

If the same button is pressed for at least the minimum threshold time, at step 640, the trainable transceiver may place the channel again in training mode for another function. The trainable transceiver may again analyze or parse the control signal for actuating a function of a remote device from an original transmitter. Based on the analysis or the parsing of the control signal, the trainable transceiver may again store the control information in memory in one of the channels.

At step 645, the trainable transceiver may proceed to determine whether the message for the second function is similar to the message for the function. The determination may be in accordance with a message similarity condition regarding the messages of the functions trained at the channel. The message similarity condition may specify that: a control signal for the previously stored function and a control signal for the new function may not be identical; the control signal for the previously stored function and the control signal for the new function are to be of the same encoding (e.g., fixed or rolling code); the two control signals are to differ in symbol sequence (e.g., binary code) by less than a predetermined number; the two control signals are to be of the same length in time; the two control signals are to be of the same frequency; and/or the two control signals are to have the same number of symbols (e.g., bits).

If at least one of the message similarity condition specifications are satisfied, the trainable transceiver may determine that the message for the second function is similar to the message for the first function. Subsequently, the trainable transceiver may configure or set the channel to control and actuate both the first function and the second function of the remote device. The method 600 may be terminated at step 650 with the successful training of the channel to two functions.

In contrast, if none of the message similarity conditions are satisfied, at step 655, the trainable transceiver may maintain the channel to control the first function. In some embodiments, the trainable transceiver may indicate successful training of the channel to the second channel (e.g., with the LED indicator on the human-machine interface). The method 600 may then be terminated at step 660 with the unsuccessful training of the channel to the second function of the remote device.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose of special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A trainable transceiver for training and controlling multiple functions with a single channel, comprising:

a channel configured to control a first function of a remote device;

a control circuit having a memory, the memory comprising:

a comparator module configured to determine that a second function of the remote device satisfies a message similarity condition with the first function; and a training module configured to train the channel to control both the first function and the second function responsive to the determination; and a button configured to cause the channel to control one or more functions of the remote device alternately responsive to pressing of the button, the one or more functions including the first function and the second function;

wherein determining that the second function satisfies the message similarity condition with the first function comprises:

identifying a first message characteristic of a first control signal for actuating the first function of the remote device;

identifying a second message characteristic of a second control signal for actuating the second function of the remote device; and determining that the first message characteristic is similar to the second message characteristic.

2. The trainable transceiver of claim 1, wherein the comparator module is configured to determine that the second function satisfies the message similarity condition with the first function by determining that a first control signal for actuating the first function has a first frequency similar to a second frequency of a second control signal for actuating the second function; and wherein the training module is further configured to train the channel to control both the first function and the second function responsive to the determination that the first frequency is similar to the second frequency.

3. The trainable transceiver of claim 1, wherein the comparator module is configured to determine that the second function satisfies the message similarity condition with the first function by determining that a first control signal for actuating the first function includes a first number of pulses equal to a second number of pulses of a second control signal for actuating the second function; and wherein the training module is further configured to train the channel to control both the first function and the second function responsive to the determination that the first number of pulses is equal to the second number of pulses.

4. The trainable transceiver of claim 1, wherein the comparator module is configured to determine that the second function satisfies the message similarity condition with the first function by determining that a first control signal for actuating the first function includes a first symbol sequence that differs from a second symbol sequence of a second control signal for actuating the second function by less than or equal to a predetermined threshold number of symbols; and wherein the training module is further configured to train the channel to control both the first function and the second function responsive to the determination that the first symbol sequence differs from the second symbol sequence by less than or equal to the predetermined threshold number of symbols.

5. The trainable transceiver of claim 1, wherein the comparator module is configured to determine that the second function satisfies the message similarity condition with the first function by determining that a first control signal for actuating the first function is of a same code type as a second control signal for actuating the second function; and wherein the training module is further configured to train the channel to control both the first function and the second function responsive to the determination that the first control signal and the second control signal are of the same code type.

6. The trainable transceiver of claim 1, wherein the button is configured to cause, responsive to a button press of a time duration longer than a threshold duration, the training module to enter a training mode to train the channel to control both the first function and the second function.

7. The trainable transceiver of claim 1, further comprising a first counter configured to maintain a first rolling code count for the first function and a second counter configured to maintain a second rolling code count the second function, responsive to the training of the channel to control both the first function and the second function and a determination that a code type of the first function and the second function is rolling code.

8. A system for training and controlling multiple functions with a single channel, comprising:

a channel of a transceiver, wherein the channel is trainable to control one or more functions of a remote device;

a button configured to control actuation of the one or more functions trained to the channel and training of the channel of the transceiver; and a control circuit having a memory, the memory configured to:

train the channel to control a first function of the remote device using a first control signal from an original transmitter, responsive to a first button press of the button, determine that a second function of the remote device satisfies a message similarity condition with the first function, responsive to a second button press subsequent to the first button press, and train the channel to control both the first function and the second function of the remote device using a second control signal from the original transmitter, responsive to the determination that the second function satisfies the message similarity condition with the first function;

wherein determining that the second function satisfies the message similarity condition with the first function comprises:

identifying a first message characteristic of a first control signal for actuating the first function of the remote device;

identifying a second message characteristic of a second control signal for actuating the second function of the remote device; and determining that the first message characteristic is similar to the second message characteristic.

9. The system of claim 8, wherein the training module is further configured to:

identify a number of functions controlled by the channel;

compare the number of functions to a predetermined threshold number of functions; and train the channel to control the second function of the remote device, responsive to the determination that the number of functions controlled by the channel is less than the predetermined threshold number of functions.

10. The system of claim 8, wherein the training module is further configured to:

cause an electronic display coupled to the transceiver to render a prompt for adding the second function to the channel, responsive to the determination that the second function satisfies the message similarity condition with the first function; and train the channel to control both the first function and the second function, responsive to receipt of an affirmative response to the prompt rendered on the electronic display.

11. The system of claim 8, wherein the training module is further configured to:

determine that a third function of the remote device does not satisfy the message similarity condition with the first function, responsive to a third button press subsequent to the second button press;

train the channel to control the third function of the remote device while overwriting the first function and the second function using a third control signal from the original transmitter, responsive to the determination that the third function does not satisfy the message similarity condition with the first function.

12. The system of claim 8, wherein the channel is configured to transmit the first control signal for actuating the first function or the second control signal for actuating the second function based on a time duration of a third button press.

13. The system of claim 8, wherein the memory further comprises a comparator module configured to:

compare the first message characteristic of the first control signal for actuating the first function and the second message characteristic of the second control signal for actuating the second function; and determine whether the first function and the second function satisfy the message similarity condition based on the comparison between the first message characteristic and the second message characteristic.

14. A method of training multiple functions to a single transceiver channel, comprising:

detecting, by a trainable transceiver, a button press on a command button corresponding to a channel, wherein the channel is trainable to control one or more functions of a remote device;

identifying, by the trainable transceiver, the channel as trained to control a first function of the remote device, responsive to detecting the button press on the command button;

determining, by the trainable transceiver, that a second function of the remote device satisfies a message similarity condition with the first function;

training, by the trainable transceiver, the channel to control both the first function and the second function, responsive to determining that the second function satisfies the message similarity condition with the first function; and configuring, by the trainable transceiver, the command button to transmit control signals to alternately actuate the first function and the second function of the remote device responsive to successive button presses;

wherein determining that the second function satisfies the message similarity condition with the first function further comprises:

identifying a first message characteristic of a first control signal for actuating the first function of the remote device;

identifying a second message characteristic of a second control signal for actuating the second function of the remote device; and determining that the first message characteristic is similar to the second message characteristic.

15. The method of claim 14, wherein detecting the button press on the command button further comprises determining that a time duration of the button press is greater than a predetermined time threshold; and wherein training the channel to control both the first button and the second button further comprises training the channel, responsive to determining that the time duration is greater than the predetermined time threshold.

16. The method of claim 14, wherein training the channel to control both the first function and the second function further comprises:

determining that a first control signal for actuating the first function is of a same code type as a second control signal for actuating the second control type; and initiating a counter for the channel to maintain a rolling code count for both the first function and the second function.

17. The method of claim 14, wherein training the channel to control both the first function and the second function further comprises:

determining that training of the channel to control the second function fails; and retraining the channel to control the second function, subsequent to determining that the training of the channel to control the second function failed.

18. The method of claim 14, further comprising:

detecting, by the trainable transceiver, a second button press on the command button subsequent to the button press;

identifying, by the trainable transceiver, the channel as trained to control the first function of the remote device, responsive to detecting the button press on the command button;

determining, by the trainable transceiver, that a third function of the remote device does not satisfy the message similarity condition with the first function; and maintaining, by the trainable transceiver, the channel to control the first function, responsive to determining that the third function does not satisfy the message similarity condition.

19. The method of claim 14, further comprising:

transmitting, by the trainable transceiver, a first control signal for actuating the first function using the channel, responsive to a first button press of the command button; and transmitting, by the trainable transceiver, a second control signal for actuating the second function using the channel, responsive to a second button press subsequent to the first button press.

* * * * *